US005440281A

United States Patent [19]

Wey et al.

[11] Patent Number: 5,440,281

[45] Date of Patent: Aug. 8, 1995

[54] MULTICHANNEL TRANSMITTER COMBINERS EMPLOYING CAVITIES HAVING LOW OUTPUT IMPEDANCE

[75] Inventors: Chia-Sam Wey; John M. Stronks; Erik W. Lilieholm, all of Reno, Nev.

[73] Assignee: Allen Telecom Group, Inc., Solon, Ohio

[21] Appl. No.: 118,121

[22] Filed: Sep. 7, 1993

[51] Int. Cl.[6] ..... H01P 5/12

[52] U.S. Cl. ..... 333/126; 333/134

[58] Field of Search ..... 333/126, 129, 134; 455/56.1, 103

[56] References Cited

U.S. PATENT DOCUMENTS

| | | | |
|---|---|---|---|
| 3,124,768 | 3/1964 | Tilston | 333/126 |
| 3,332,038 | 7/1967 | Stanley et al. | 333/129 |
| 4,375,622 | 3/1983 | Hollingsworth et al. | 333/126 |
| 5,034,707 | 7/1991 | Kagstrom | 333/126 |

FOREIGN PATENT DOCUMENTS

| | | | |
|---|---|---|---|
| 103656 | 8/1979 | Japan | 333/126 |

*Primary Examiner*—Paul Gensler

*Attorney, Agent, or Firm*—Laff, Whitesel, Conte & Saret, Ltd.

[57] ABSTRACT

A multichannel combiner includes a plurality of input ports for connection to associated transmitters, narrow bandpass filters associated with each port, and an output port for connection to an antenna system. The output impedance of the filters is selected to be substantially lower than that used in conventional combiners, such that undesired reactance produced in the combiner over its operating range is much reduced. The combiner further includes an impedance transformer to match the low output impedance of the filters to the design impedance of the antenna system.

5 Claims, 19 Drawing Sheets

500

326
348
554b
344
554a
350
312

318
322
310
336
340
324
314
510
352

MULTICHANNEL TRANSMITTER COMBINERS EMPLOYING CAVITIES HAVING LOW OUTPUT IMPEDANCE

BACKGROUND OF THE INVENTION

This invention relates to radio communications systems, and more particularly to apparatus and methods for coupling a plurality of transmitters having non-identical but relatively close output frequencies to a single antenna.

In the recent past, radio communications systems, such as cellular telephone systems and trunked radio systems, have been developed which can provide vast amounts of capacity to handle communications traffic between mobile and portable subscribers and land-based communications systems. In some cases, these systems can support the communications needs of many thousands of users.

Such radio systems achieve their significant communications capacity, in part, by dividing the geographical area in which coverage is desired into small regions (or cells) and deploying therein land-based radio transmitting and receiving equipment sufficient to meet the traffic requirements of that region. Because each region is relatively small, both the mobile stations and the land stations may use relatively low transmitter power. As a result, when a channel is in use in a particular region, that channel may be simultaneously reused in a non-adjacent region only a short distance away.

However, another key to the large capacity of modern radio communications systems is providing a very large number of available radio channels in each small region. For example, in the domestic cellular telephone service, 416 channels are available to each system operator, and an operator may typically allocate 25–30 of those channels for use in a particular region or cell. The large number of available channels span a wide frequency range. For example, in the domestic cellular service, the channels allocated for transmitting from the base station to the subscriber terminal extend from 869 MHz to 894 MHz, a range of about 25 MHz.

For a variety of reasons, the land-based radio equipment for all of the channels provided in each region or cell is generally located at a very small number of places therein. Typically a single base station is used in each region, but in some systems remote base stations may be provided to increase capacity or to avoid coverage defects due to buildings or topography. Accordingly, a single base station site may have 30 or more pairs of radio transmitters and receivers.

A significant problem in the design of base station equipment where a large number of channels must operate simultaneously is attaching the transmitters and receivers to suitable antennas. Although it is conceivable that a separate antenna could be provided for each receiver and transmitter, that solution has many disadvantages. Conventional antennas generally must be located some distance away from other antennas for proper operation, and therefore, providing separate antennas for each transmitter and receiver would require unacceptable amounts of "real-estate" on the towers or buildings on which they are mounted. A transmission line must be provided to connect each antenna to the associated radio equipment. The size and weight of a large bundle of transmission lines is unacceptable in many installations. Further, since the antennas and the transmission lines are exposed to the environment, a large number of antennas and transmission lines create a significant maintenance burden. In addition, the antennas and transmission lines are costly.

Designers of radio systems have sought and developed ways to connect a large number of transmitters or receivers to a single antenna. Special problems occur when attempting to connect multiple transmitters to a single antenna, because the transmitters, by definition, generate radio-frequency (RF) energy. In general, it is not feasible to simply connect several transmitters, in parallel, to an antenna, because each transmitter would appear as a load to the other transmitters. Thus, the RF energy produced by one transmitter would, at least in part, be dissipated in the other transmitters. This is inefficient, because a substantial portion of each transmitter's output may be dissipated in other transmitters instead of being radiated by the antenna. In addition, the RF energy received from other transmitters is dissipated in the form of heat, so that if a transmitter receives sufficient RF energy from other transmitters, it may be damaged.

Accordingly, radio system designers have developed "combiners" for properly coupling the RF energy produced by several transmitters to a single antenna/transmission line. A simplified block diagram of a prior art combiner 100 is shown in FIG. 1. The conventional combiner 100 chosen for illustration herein is adapted for use with up to 20 transmitters, but combiners of smaller or larger capacity have been constructed. Further, although the conventional combiner 100 is of a design suitable for use in the 750–1250 MHz frequency range, combiners of various designs are available for a wide range of frequencies.

As best seen in FIG. 1, a conventional combiner comprises a plurality of input ports **110*a*–110*t* for receiving RF energy from transmitters 152 via suitable transmission lines 154. Each input port 110*a*–110*t* is connected to a respective filter means 112. Each filter means 112 is generally a relatively narrow bandpass filter having its passband centered about the frequency on which the associated transmitter 152 operates. Although the filters 112 may be implemented using a variety of technologies, the filters provided in typical commercial combiners for use in the 150–1500 MHz frequency range are implemented using cavity resonators which may include a ceramic dielectric element. The output signal from the transmitter is introduced into, and collected from, the filter 112 using any means appropriate for the type of filter being used. For the cavity resonators described herein, wire loops 138, 142 are used, but other means, such as probes, could also be used. An adjustment means 136 is provided to control the resonant frequency of the filter. The signal from the transmitter is provided at an output port 114** of the filter.

The filters 112 function to preclude RF energy produced by one transmitter from being delivered to any other transmitter. The filter passband is selected to be wide enough to pass the transmitted signal, but narrow enough to reject the frequencies on which all other transmitters at the site operate. Thus, for each transmitter, the associated filter rejects substantially all of the RF energy which may be available from the other transmitters at the site.

Although regulatory standards for modern communications systems provide for adjacent channel spacing of 15 to 50 kHz, in practice, it is difficult and expensive to construct filter elements suitable for operation of multiple transmitters on immediately adjacent channels. To partially avoid this problem, the channels selected for use at a particular site are chosen such that each operating channel is separated from adjacent operating channels by several non-operating channels.

The minimum allowed frequency difference between adjacent channels for a combiner is a design parameter and is referred to as "channel separation." Channel separation in commercial communications systems typically ranges from approximately 150 kHz to approximately 900 kHz. The channel separation is an important design parameter affecting system performance. Although a designer may accommodate the need for reduced channel separation by increasing the loaded Q of the filter, thereby increasing the slope of the filter's response curve, increasing the loaded Q also increases the insertion loss of the filter, thereby reducing the amount of transmitter-produced RF energy which is delivered to the antenna.

The remaining portions of the conventional combiner 100 are provided to achieve the physical interconnection between the output ports 114 of the filters 112 and the transmission line 132 to the antenna 134. A primary transmission line 116 connects the output port 114 of each filter to a corresponding input port 140 of one of four primary junction assemblies 118*a*, 118*f*, 118*k*, 118*p*. Each primary junction assembly 118 has five input ports 140 which are connected in parallel to a single output port 122.

A secondary transmission line 124 connects the output port 122 of each primary junction assembly 118 to a secondary junction assembly 126. The secondary junction assembly 126 has four input ports 144 which are connected in parallel to a single output port 128. The output port 128 of the secondary junction assembly 126 is connected to a transmission line 132 which is, in turn, connected to the antenna 134. Two cascaded "layers" of small junction assemblies 118 and 126 are provided instead of a single large 20-input junction assembly because it is difficult to construct large junction assemblies in which the transmission path between the input ports and the central junction has the desired transmission line characteristics.

In connecting the output ports 114 of the filters 112 to the combiner's final output port 128, it is desirable to avoid introducing reactance which may be caused by the transmission lines 116 and 124 and the junction assemblies 118 and 126. Accordingly, a conventional combiner 100 of the type described herein is typically constructed such that the effective electrical length of each transmission path from the output port 114 of a filter 112 to the final output port 128 closely approximates an integral multiple of one half wavelength at the center of the combiner's operating frequency range. A transmission line having an electrical length of exactly an integral multiple of one half wavelength is electrically "invisible" in that it contributes no reactance to the circuit.

The undesired introduction of reactance into the transmission line circuit from various combiner components significantly degrades the performance of the conventional combiner 100 of FIG. 1. Commercial antennas and transmission lines are typically designed to have input and characteristic impedances, respectively, in the range of approximately 50 to 75 ohms. An impedance mismatch between the combiner and the antenna circuit, which may be caused by undesired reactance in the combiner, causes power to be reflected back or "returned" to the transmitters. The reflected power is dissipated as heat in the transmitter and if it is sufficiently large, may damage the transmitter. In addition, any power reflected by the antenna circuit is obviously not radiated. In addition, the undesired reactance increases the insertion loss of the combiner.

The undesired reactances produced in the conventional combiner 100 of FIG. 1 are caused by two principal sources, in cooperation: the filter means 112, and the transmission line components 116, 124. The cavity resonators used to implement the filter means 112 produce little reactance themselves at exactly their resonant frequency; at frequencies far removed from their resonant frequencies, they appear as open circuits and thus also produce little reactance.

Thus, at the output frequency of a particular transmitter, there will be virtually no reactance directly contributed by the transmitter's associated cavity, which is resonant at that output frequency. However, when the cavity is connected to a length of transmission line, as it necessarily is in a combiner, the impedance of the cavity as seen through the transmission line will vary depending on the output impedance of the cavity, the characteristic impedance of the line, and the length Of the line. If the effective electrical length of the transmission line is exactly an integral multiple of one half wavelength, there will be no reactance contribution apparent from the cavity, regardless of the impedance of the transmission line.

However, if the electrical length of the transmission line is not exactly an integral multiple of one half wavelength, the transmission line will transform the impedance of the cavity, even at resonance, such that the cavity appears reactive. Typically, the transmission line lengths in a combiner will be "exactly" an integral multiple of one half wavelength only at the combiner center frequency. Thus, at all other frequencies in the operating band, errors in the effective length of the transmission line segments will produce a reactance visible at the end of the transmission line. This reactance contribution is attributed to the associated cavity.

A first reactance contribution source to be considered is a cavity far off resonance. At a frequency far from its resonant frequency, a cavity exhibits a very high resistance and appears essentially as an open circuit. From the point of view of a transmitter operating at the low end of the combiner's frequency range, transmission-lines which are intended to be one half-wavelength are "short". Thus, the open circuits presented by far-off-resonance cavities are transformed by their associated transmission lines as a pure inductance. From the point of view of a transmitter operating at the high end of the combiner's frequency range, transmission lines which are intended to be one half-wavelength are "long", and therefore, the open circuits presented by far-off-resonance cavities are transformed by their associated transmission lines as a pure capacitance.

A second reactance contribution source to be considered is a cavity at resonance. A cavity at resonance itself exhibits negligible reactance. In practical combiners, each cavity is connected to a transmission line, which is typically intended to have an electrical length of an integral multiple of one half wavelength, at the combiner center frequency. However, since most, if not all, of the transmitters and their associated cavities are tuned to a frequency other than the combiner center frequency, from the point of view of these transmitters, the transmission lines will be either "long" or short.

The amount of reactance contributed by a resonant cavity at a selected frequency, and the sign of the reactance (i.e. whether the contributed reactance is inductive or capacitive), depends on the output impedance of the cavity and whether the selected frequency is above or below the combiner center frequency.

At a frequency near the low end of the combiner operating range, the transmission line will appear short. If the output impedance of the associated cavity is higher than the characteristic impedance of the transmission line, then the "short" transmission line will transform the resistance of the cavity to an inductive reactance. At a frequency near the high end of the combiner operating range, the transmission line will appear long. If the output impedance of the associated cavity is higher than the characteristic impedance of the transmission line, then the "long" transmission line will transform the resistance of the cavity to a capacitive reactance.

Because it is generally desirable to match the combiner's output impedance to the input impedance of the antenna circuit, cavities of conventional combiners 100 have been designed with relatively high output impedances. Early combiners used cavities with output impedances in the range of 50–60 ohms. Thus, many conventional combiners behave as described above: resonant cavities contribute inductance at the low end of the operating range and capacitance at the high end of the operating range. Unfortunately, this reactance contribution operates in the same direction as the contributions from far-off-resonance cavities and associated transmission lines, and therefore, large amounts of undesired reactance contributions are produced. This results in particularly poor performance in many conventional combiners.

FIG. 7 is a Smith Chart 202 representing a computer simulation of the output match presented by a 20-channel combiner of conventional design over a range of operating frequencies at selected output impedances. The simulation calculates the output match (i.e. the match as seen at the output terminal of the combiner) as the resonant frequency of a single channel cavity is swept over the frequency range of interest. Portions of the chart above the equator 214 represent inductive reactance; portions of the chart below the equator 214 represent capacitive reactance. Curves 204, 206, 208, 210, and 212 represent the output match of the combiner using cavities having design impedances of 50, 40, 30, 20, and 10 ohms respectively. The remaining channel cavities are assumed to be substantially detuned from the frequency range of interest. Thus, the curves of FIG. 7 include the reactance contributed by the swept cavity at resonance, and the reactance contributed by the remaining cavities far from resonance.

Thus, as best illustrated by curve 204 of FIG. 7, a combiner employing a cavity having a design impedance of 50 ohms produces relatively large amounts of inductive reactance at frequencies below the combiner center frequency, and relatively large amounts of capacitive reactance at frequencies above the combiner center frequency. As noted above, large amounts of reactance contributed by combiner components degrades the performance of the combiner.

On the other hand, if the output impedance of a resonant cavity is lower than the characteristic impedance of the transmission line, then at frequencies near the low end of the combiner operating range, a "short" transmission line will transform the resistance of the cavity to a capacitive reactance. At a frequency near the high end of the combiner operating range, a long transmission line will transform the resistance of the cavity to an inductive reactance. Thus, where the cavity output impedance is low, compared to the characteristic impedance of the transmission line, the reactance contributions from resonant cavities (and associated transmission lines) are opposite in direction from the reactance contributions of far-off-resonant cavities. When this condition exists, these reactance contributions may, to some extent, compensate each other.

Accordingly, some designers of prior art combiners have sought to reduce the reactance contribution of the cavities by employing cavities having a somewhat lower design impedance. Combiners employing cavities with design impedances as low as 35 ohms have been constructed. Although the performance of such combiners may have improved somewhat due to the reduction in the reactance contributed by the cavities, the relatively low design impedance of the cavities resulted in a poor impedance match when used with a standard 50–75 ohm antenna system. In addition, the 35 ohm output impedance of the cavities did not produce sufficient reactance contributions from resonant cavities to effect the desired compensation of reactance contributions from far-off-resonant cavities. Thus, the prior-art use of low-output-impedance cavities did not result in the desired overall system performance improvement.

The computer-simulated performance of a 16-channel combiner of conventional design is summarized in FIGS. 2–3. The combiner is designed to operate in a 33 MHz bandwidth around 933.5 MHz, with a channel separation of 300 kHz. In order to illustrate worst case performance, the lowest available 16 channels within the specified operating range were selected. This condition maximizes the reactances produced by the cavities and the transmission lines. FIGS. *2a–2d* present diagrams **260*a*–260*d* representing the insertion loss of a conventional combiner in the frequency range of 916 to 922 MHz. FIGS. *3a–3b* present diagrams 262*a*–262*d*** representing the output return loss of the conventional combiner over that frequency range.

As best seen in FIGS. *2a–2d,* the insertion loss increases dramatically with frequency. At the highest selected frequency, the combiner has an insertion loss of about 4.3 dB (i.e. only about 37 percent of the original signal is available at the output of the combiner). As best seen in FIGS. *3a–3b,* the output return loss decreases dramatically with frequency. At the highest selected frequency the output return loss is less than 5.0 dB (i.e. about 32 percent of the power available at the output of the combiner is returned as reflected power). Thus, a significant improvement in combiner performance is highly desirable.

In order to attempt to compensate the reactances produced by the cavities and the transmission lines, adjustable reactance elements 120 or 130 have been provided in conventional combiners at primary or secondary junctions 118, 126 respectively, or at other suitable locations. For example, in some prior art combiners, a shorted stub of adjustable length is connected in shunt to the center junction point of the primary or secondary junction assemblies.

This technique may allow a user to optimize the performance of the combiner for a particular limited range of frequencies. For example, for conventional combiners designed for operation in a particular 25 MHz band in the 900 MHz region, this reactance compensation technique may permit the user to select a 10 MHz segment in which the combiner provides acceptable performance. However, this technique has the disadvantages of limiting the usable bandwidth of the combiner and it requires manual adjustment.

OBJECTS AND SUMMARY OF THE INVENTION

It is therefore an object of the present invention to provide a multichannel combiner which provides improved performance over a wider range of frequencies, compared to conventional combiners.

It is another object of the invention to provide a multichannel combiner which provides acceptable performance over a wide usable bandwidth.

It is further object of the invention to provide a multichannel combiner which provides acceptable performance without requiring user adjustment of a reactance compensation element.

It is an additional object of the present invention to provide a multichannel combiner which minimizes the reactance contributions of filtering elements over a wide range of frequencies.

It is another object of the invention to provide a self-compensating multichannel combiner in which the reactance contributions of the filter elements compensate, at least in part, the reactance contributions of the transmission line elements.

A multichannel combiner constructed according to the present invention comprises a plurality of input ports for receiving radio frequency energy from associated transmitters, and an output port for connection to an antenna transmission line. Each transmitter operates on a frequency which is different from the other transmitters and which is separated from all other transmitter frequencies by at least a predefined minimum channel separation.

Each transmitter input port is connected to a narrow band pass filter, such as a cavity resonator, which is tuned to the frequency of the associated transmitter. For each filter, the filter pass band and other characteristics are selected to reject substantially all RF energy from transmitters on other frequencies. The output ports of the filters are connected together at one or more junction assemblies. In applications where it is necessary for the combiner to accommodate a large number of channels, the junction assemblies may be cascaded or daisy-chained.

The radio frequency transmission path from the output of each filter to the final junction point is constructed so that its effective electrical length at the center of the combiner's design frequency range approximates an integral multiple of one half wavelength. As a result, the transmission path is electrically invisible at the center frequency, but contributes reactance at frequencies displaced therefrom.

The output impedance of the filters is chosen to be substantially lower than that used in conventional combiners. The filter output impedance is preferably selected, consistent with other system design constraints, to minimize off resonance reactance contributions from the filters. The filter output impedance is further selected so that the off-resonance reactance contribution from the filters is opposite the reactance contributions from filters at resonance (including, in both cases, the effects of transmission lines). This provides a self-compensation feature which substantially reduces the undesired reactance produced in the combiner over its operating range. The actual filter output impedance required in a particular implementation may be determined through computer optimization. In many applications, suitable filter output impedances will be in the range of 10–18 ohms.

The combiner further comprises an impedance transformer to match the low output impedance of the filters to the design impedance of the antenna system. The impedance transformer may be implemented using a quarter-wave transmission line section or any other suitable impedance transformer means. The transmission line section may be constructed as a coaxial transmission line section or a strip line section.

Simulations of the electrical performance of a combiner constructed according to the invention show that the inventive combiner provides acceptable performance over a 35 MHz frequency range. Insertion loss and output return loss characteristics are significantly improved over conventional combiners.

BRIEF DESCRIPTION OF THE DRAWINGS

These and other features of this invention will be best understood by reference to the following detailed description of a preferred embodiment of the invention, taken in conjunction with the accompanying drawings, in which.

Figure 1:
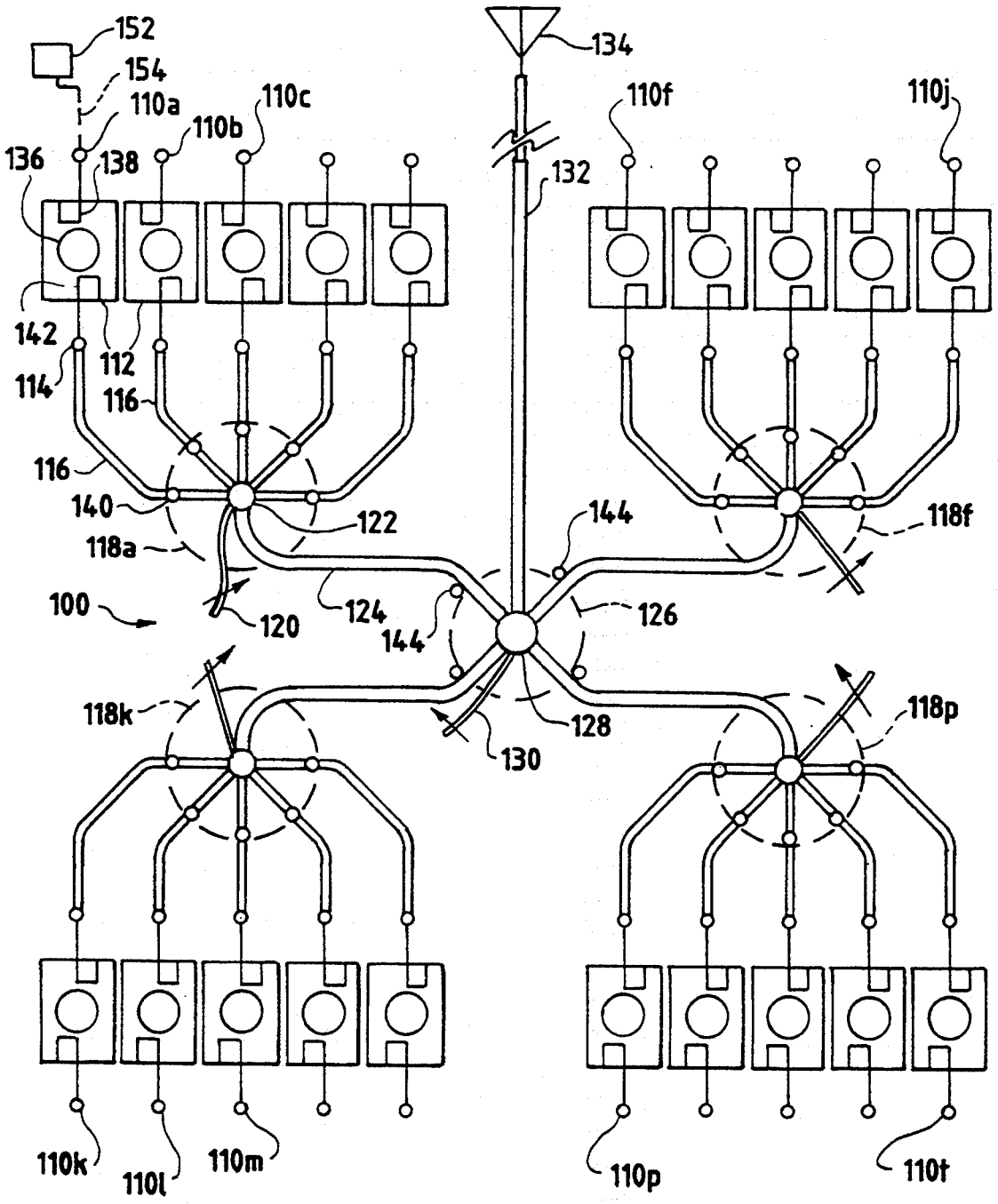
FIG. 1 PRIOR ART
FIG. 1 is a simplified block diagram of a combiner system constructed according to the prior art.
Figure 2A:
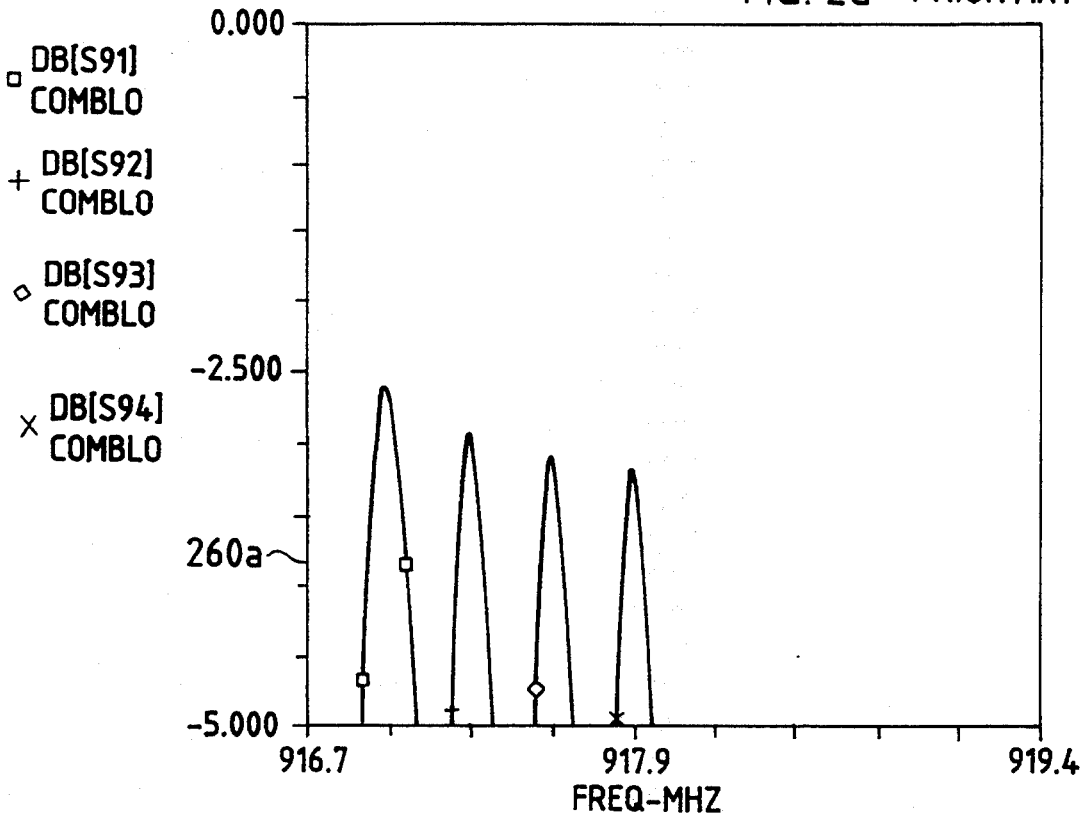
FIG. 2a PRIOR ART
Figure 2B:
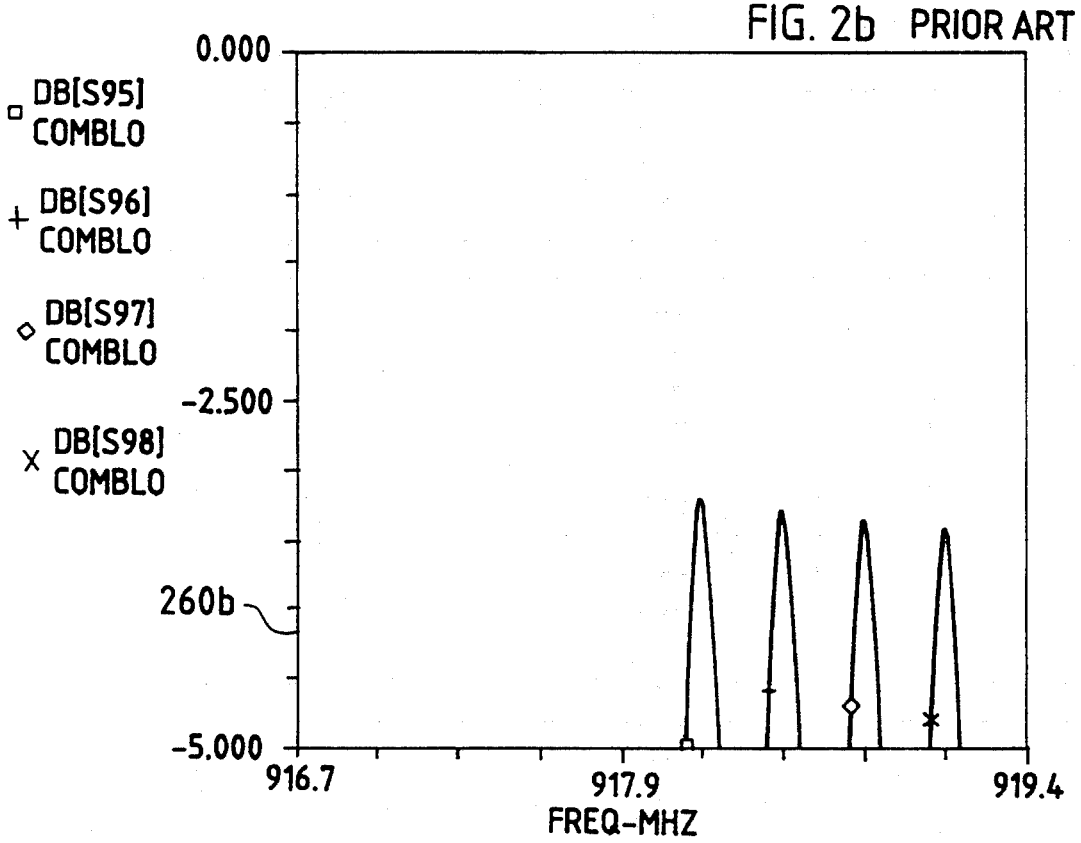
FIG. 2b PRIOR ART
Figure 2C:
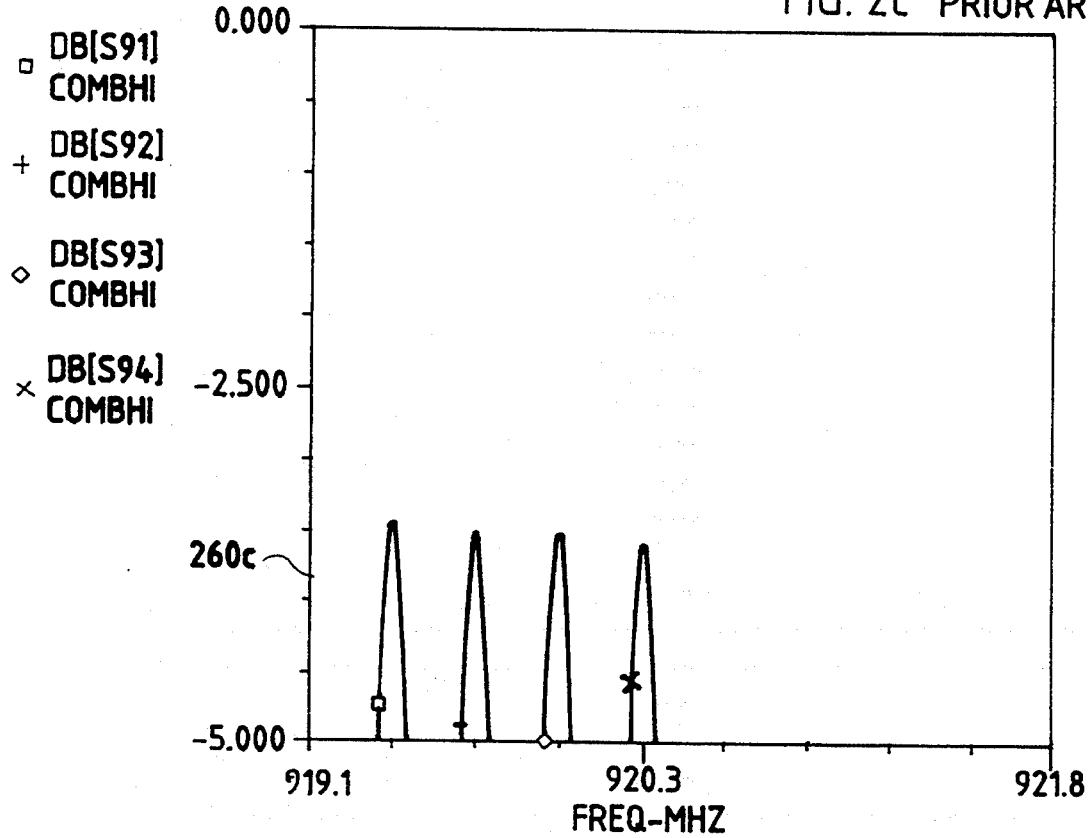
FIG. 2c PRIOR ART
Figure 2D:
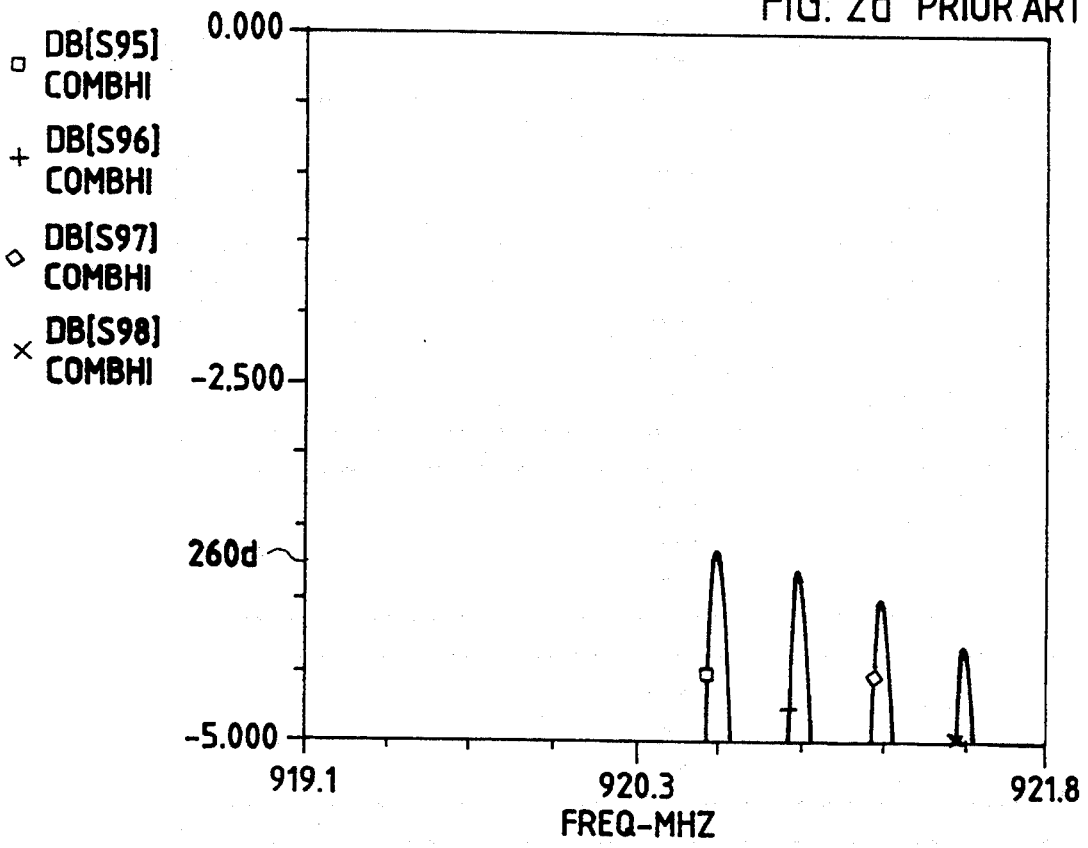
FIG. 2d PRIOR ART
Figure 3A:
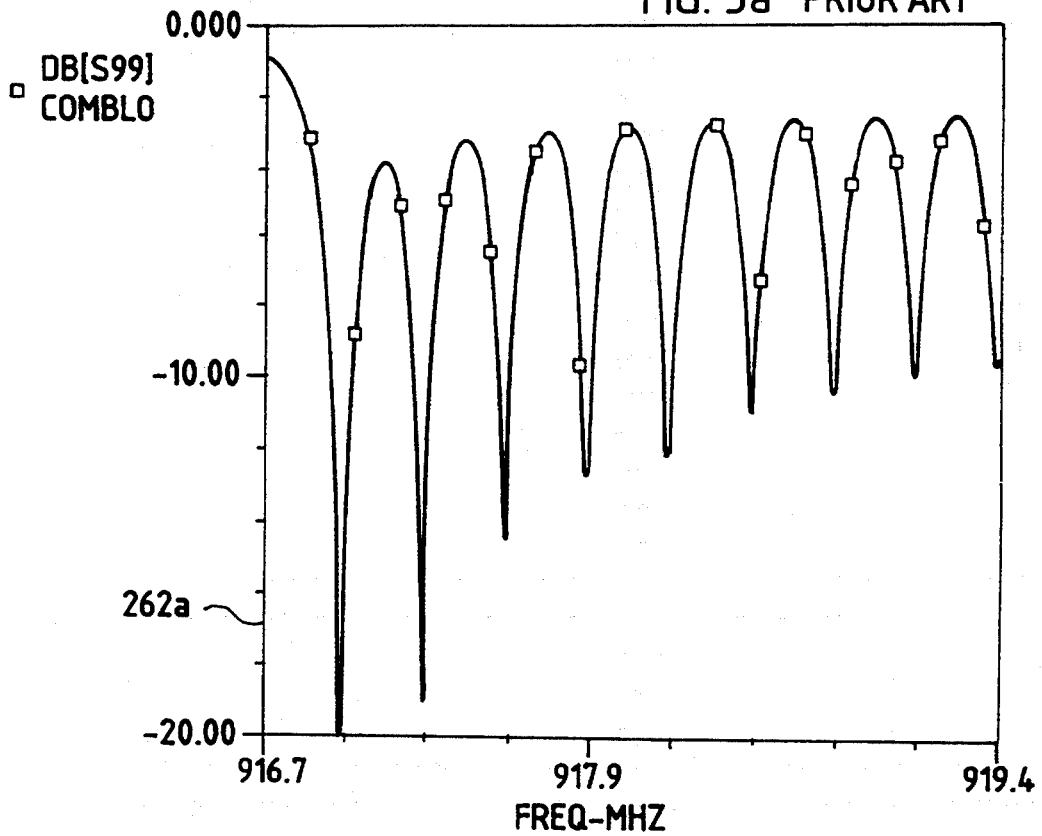
FIG. 3a PRIOR ART
Figure 3B:
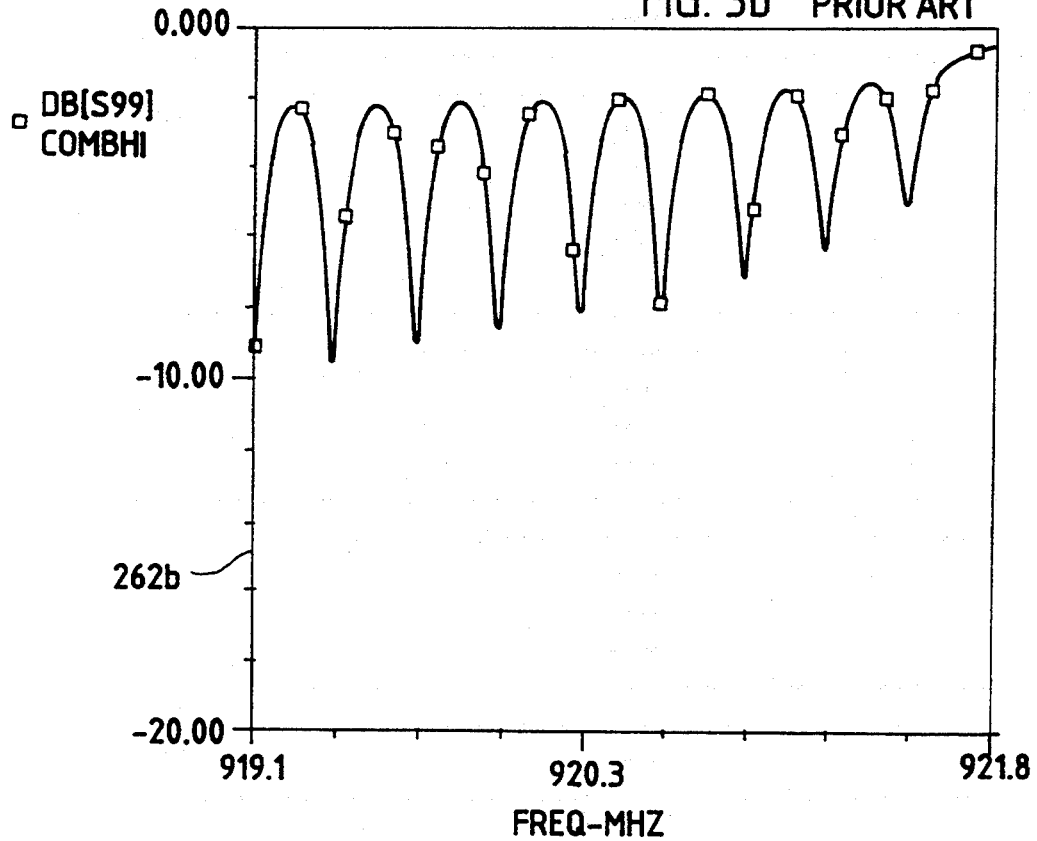
FIG. 3b PRIOR ART
Figure 4:
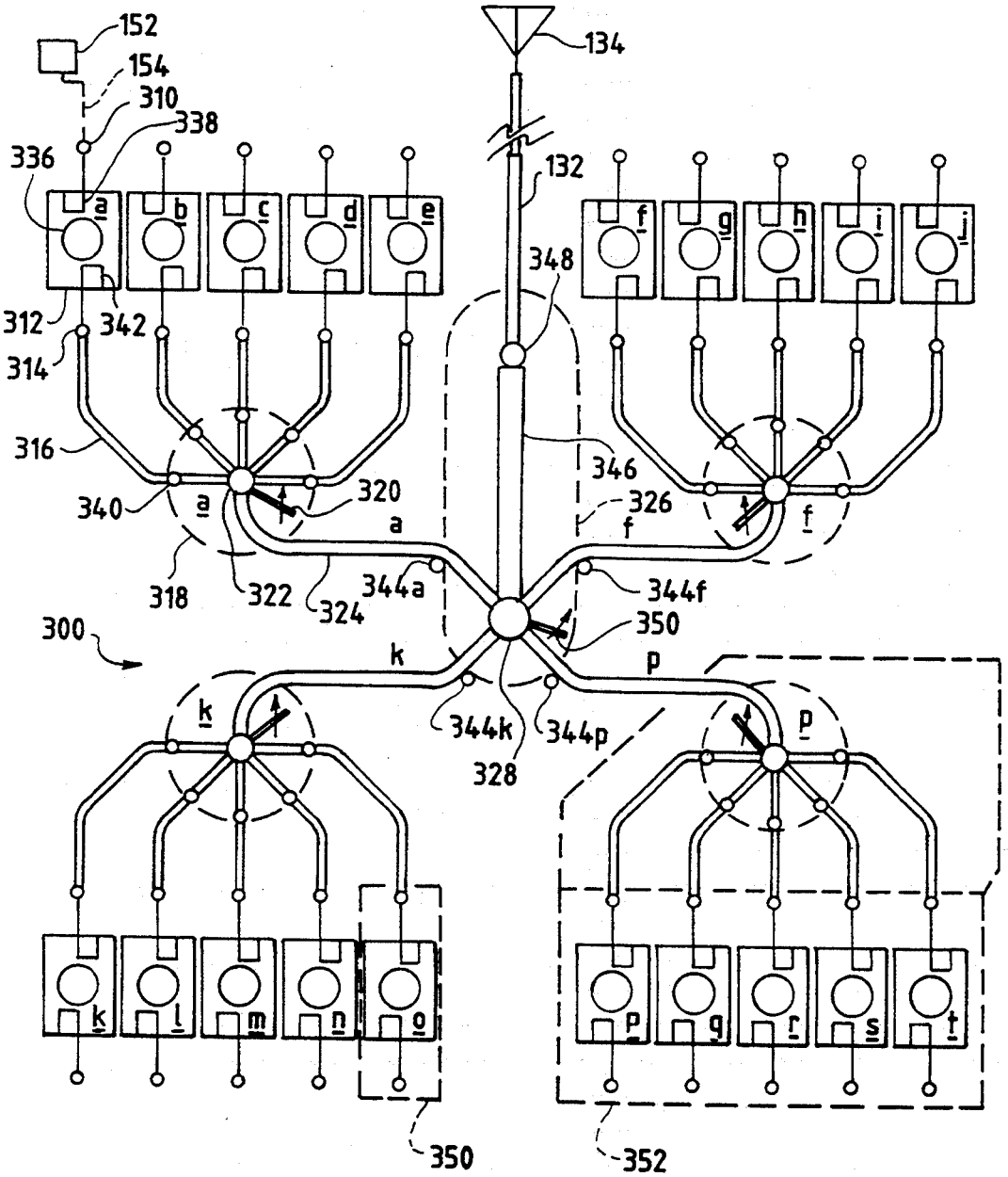
Figure 5A:
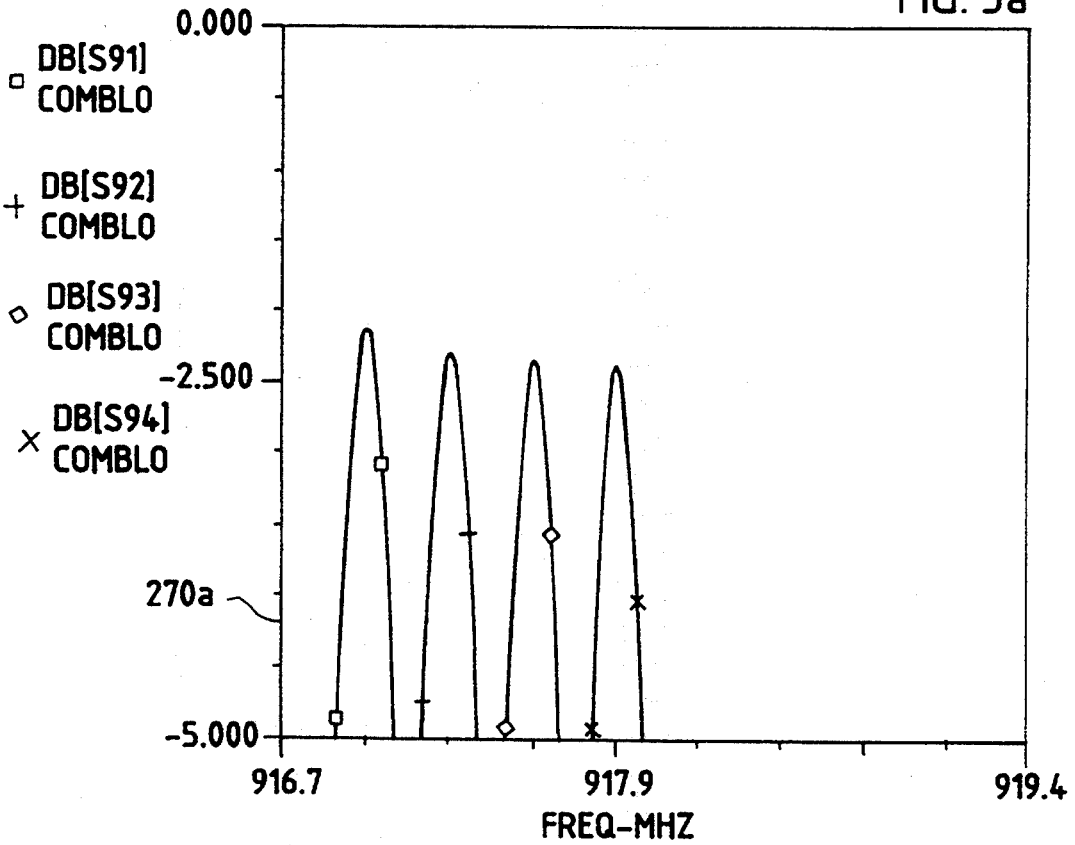
Figure 5B:
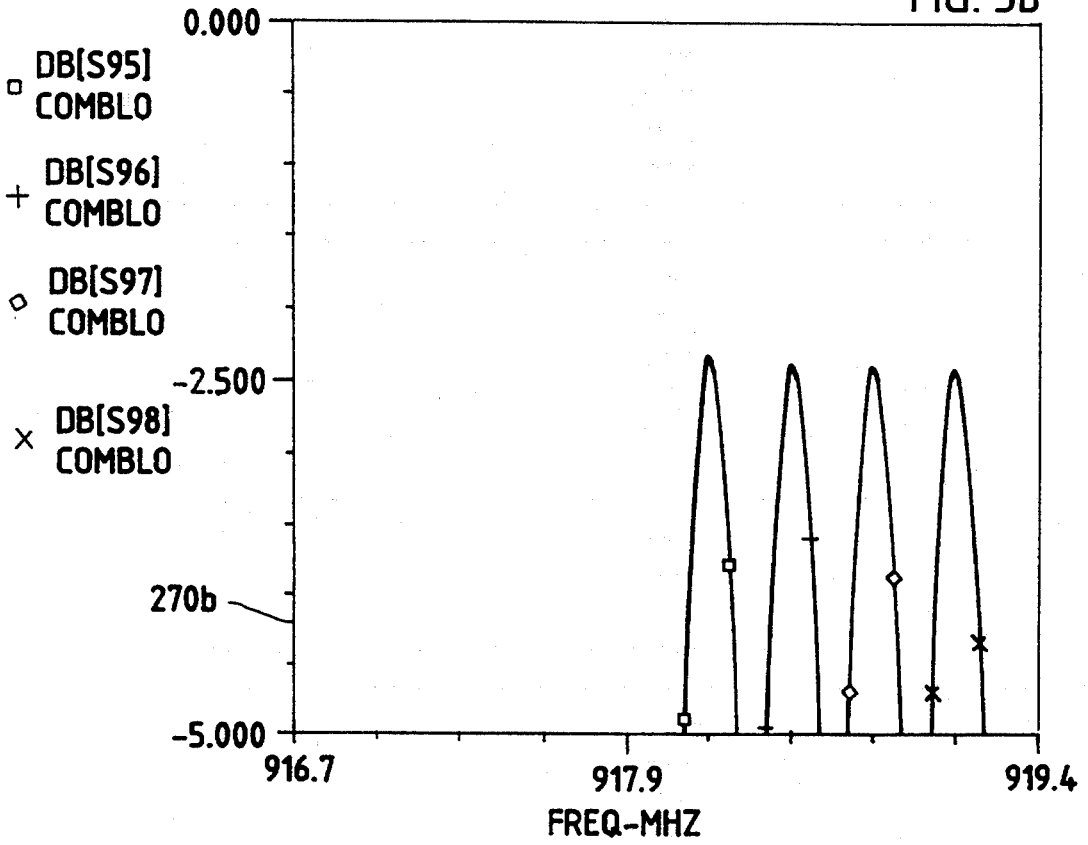
Figure 5C:
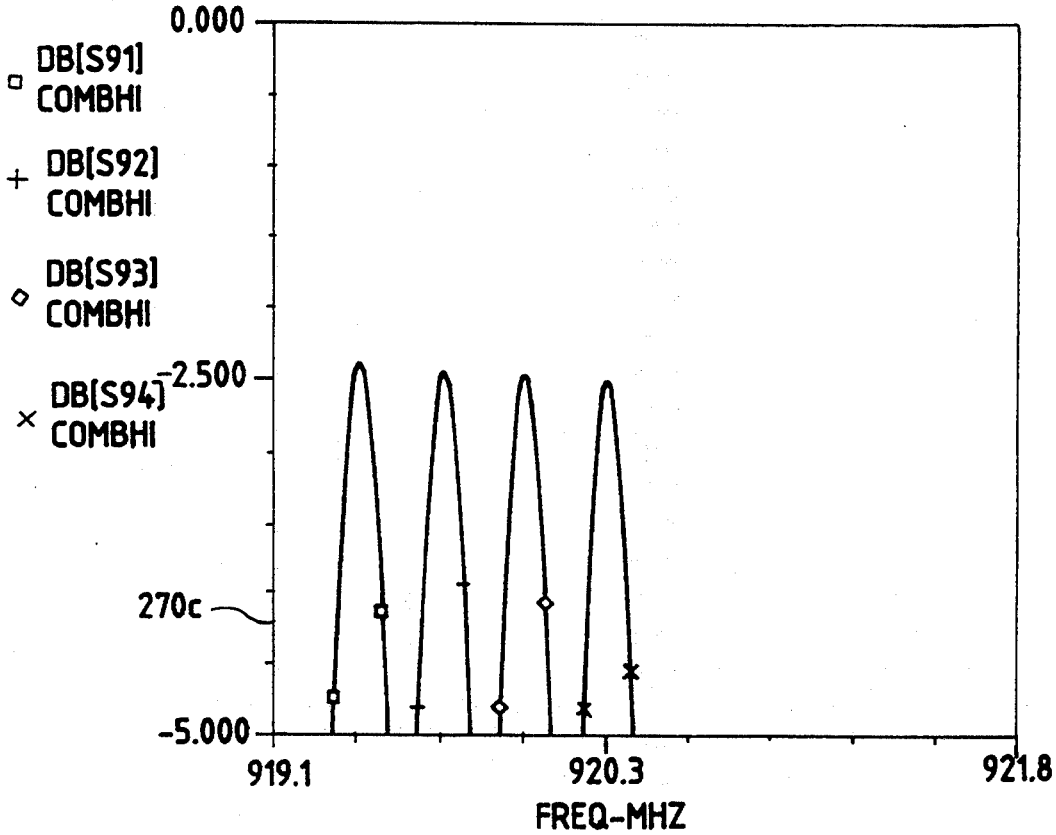
Figure 5D:
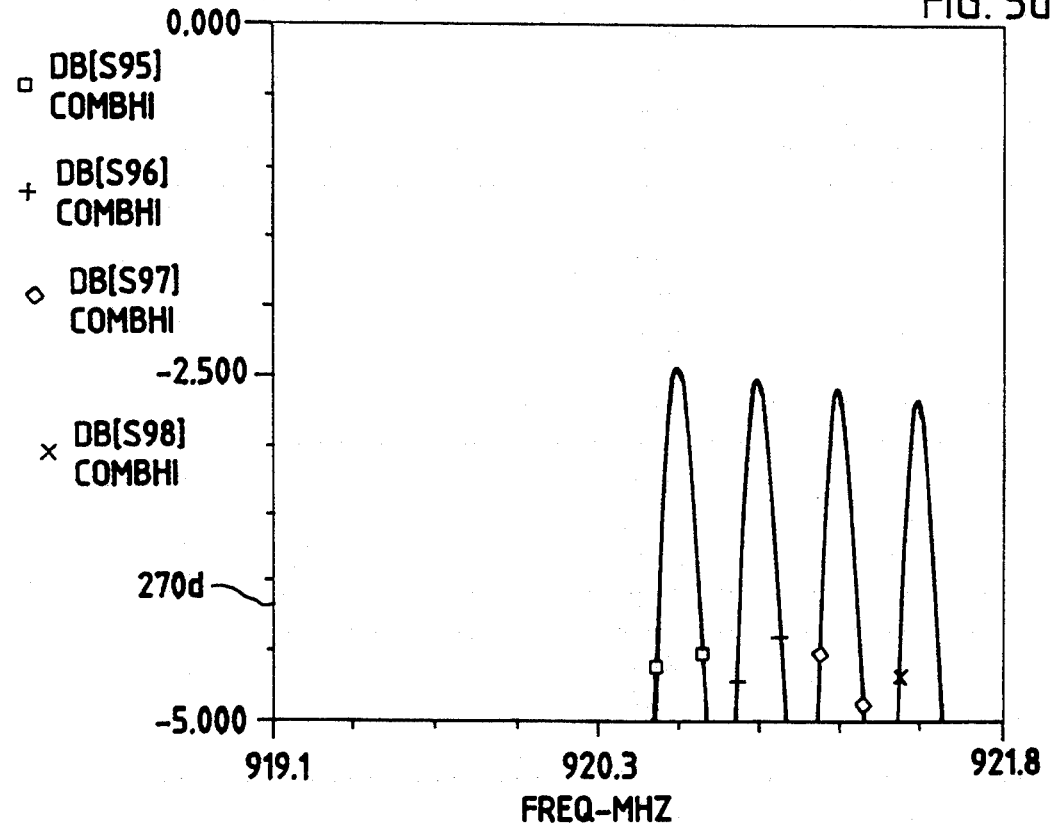
Figure 7:
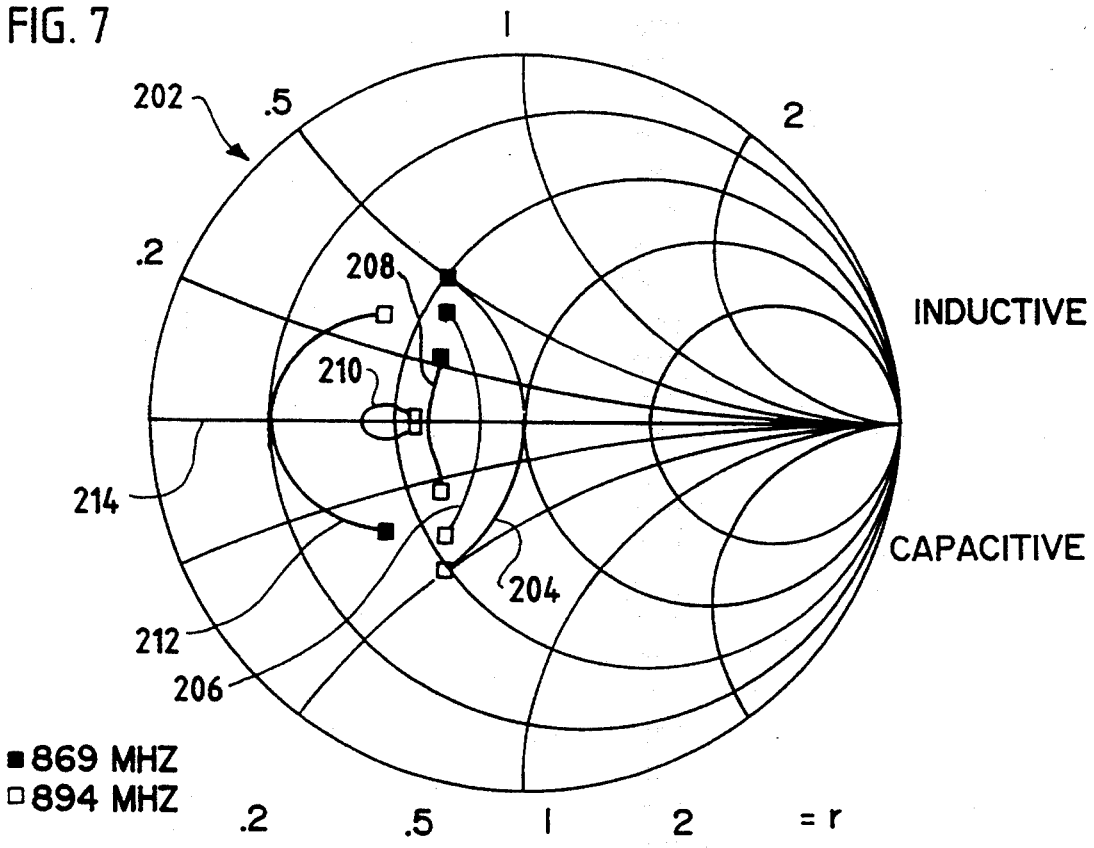
Figure 8:
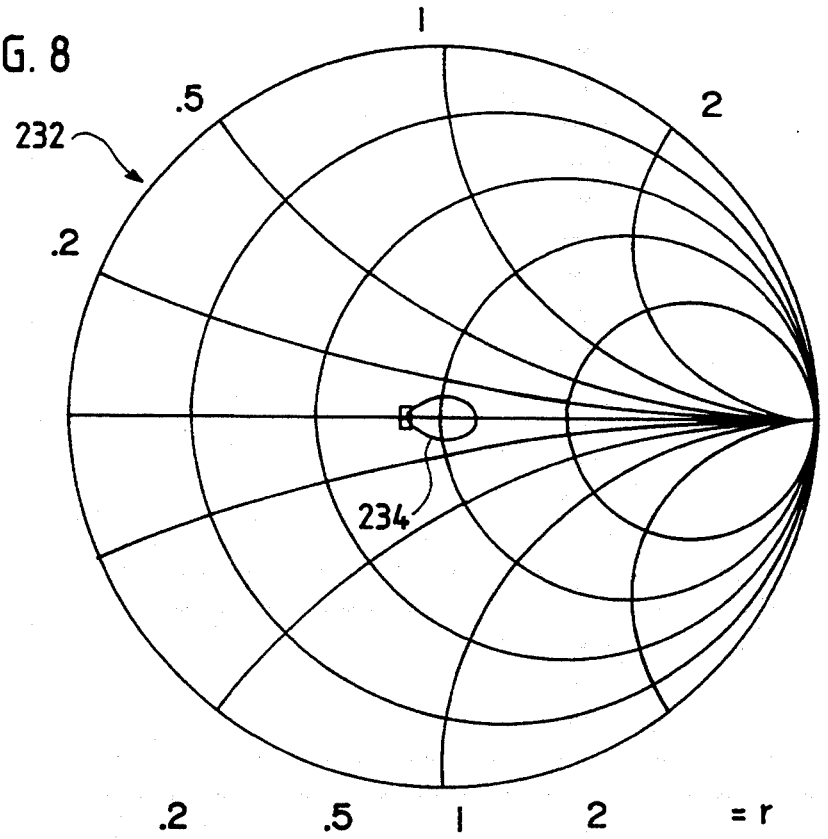
Figures 9, 10, 13:
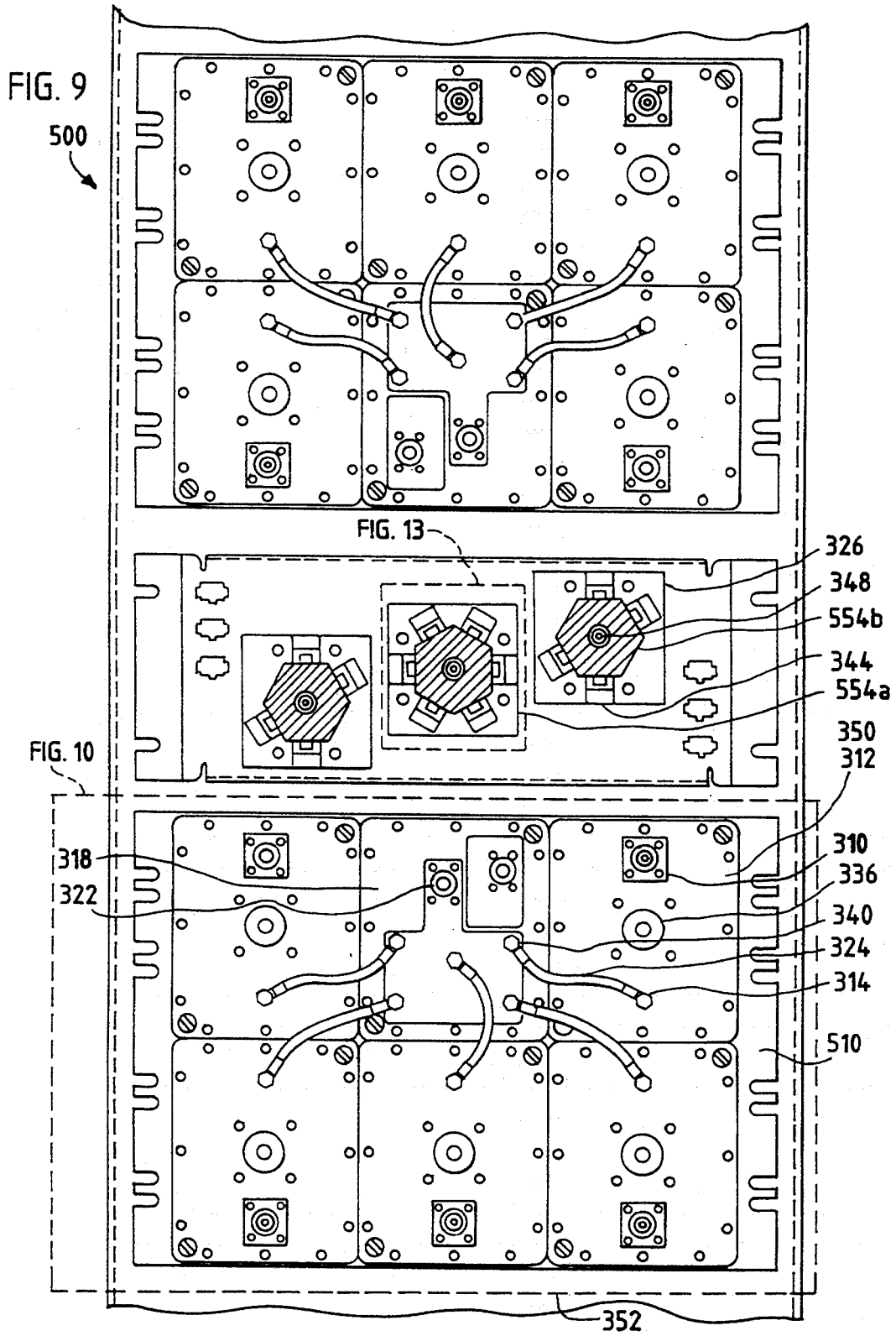
Figure 10:
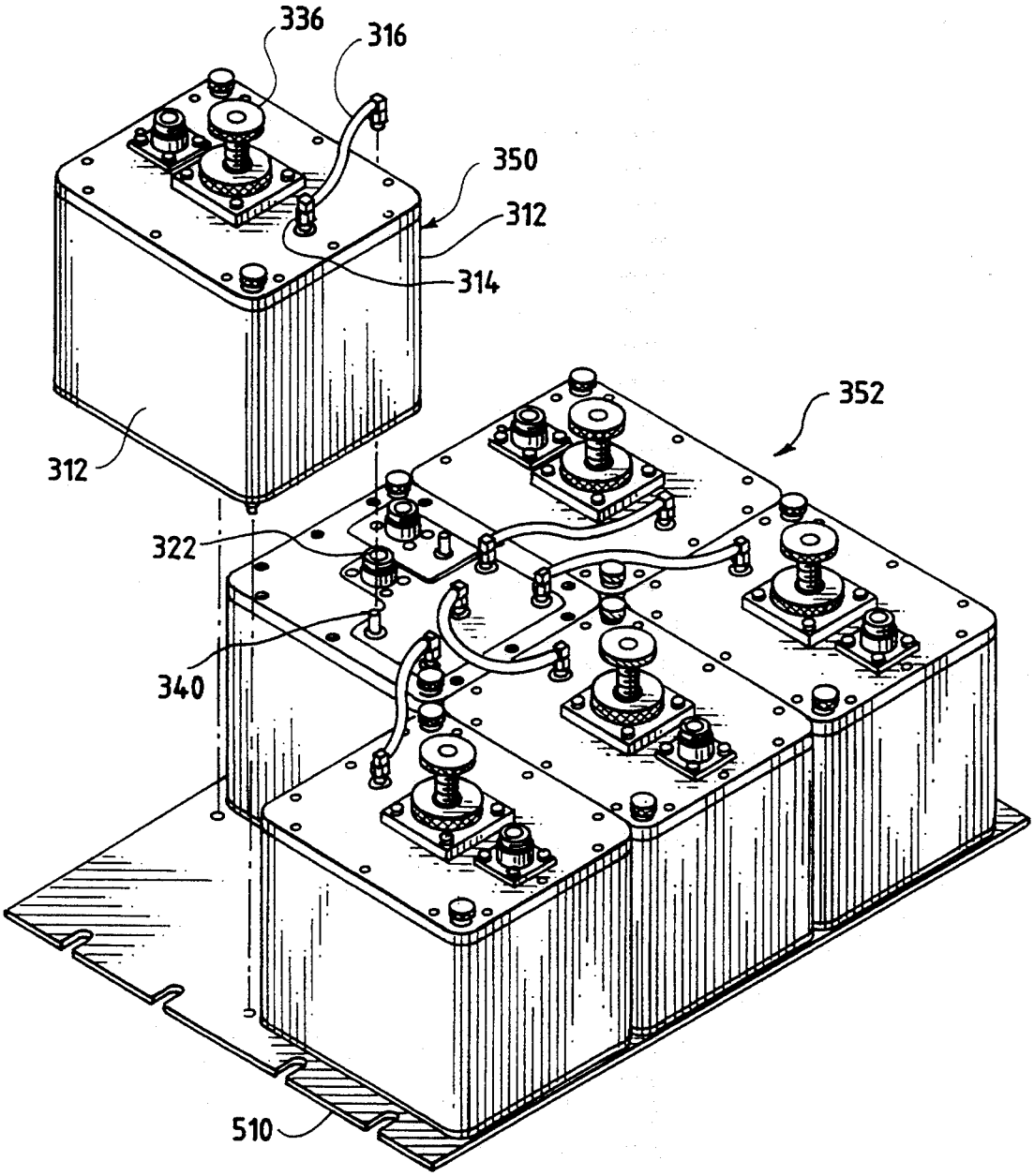
Figure 11:
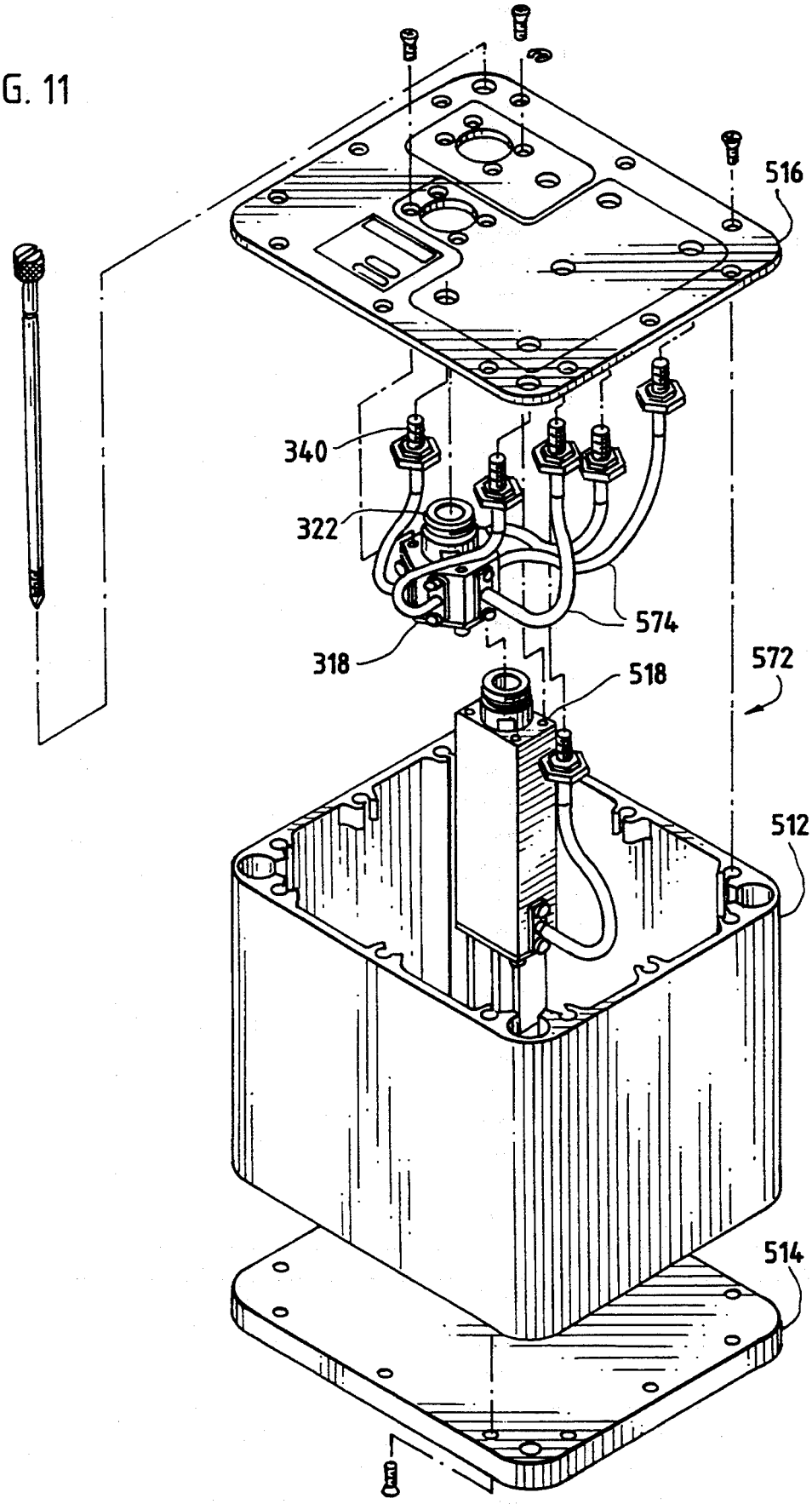
Figure 12:
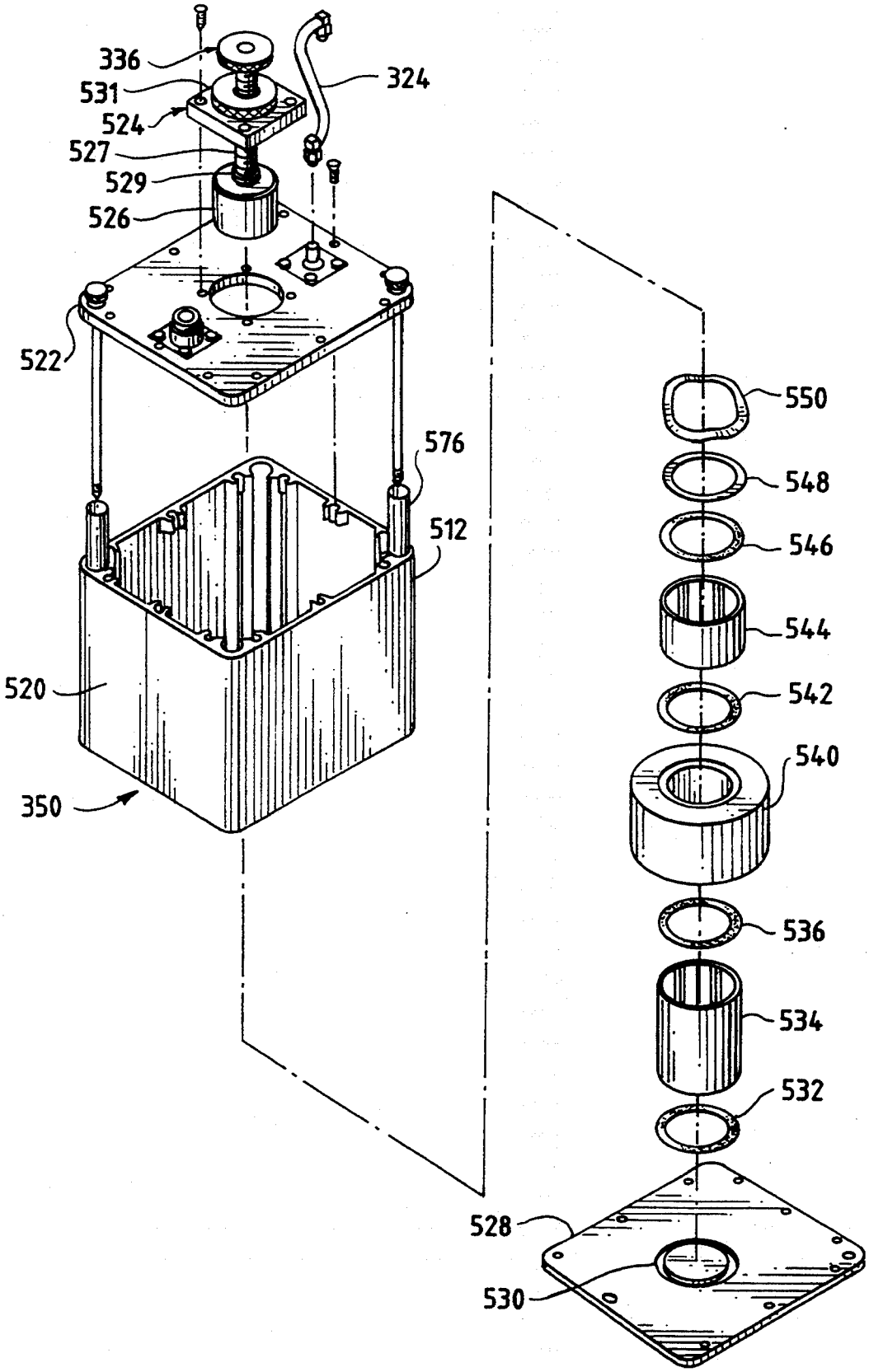
Figure 13:
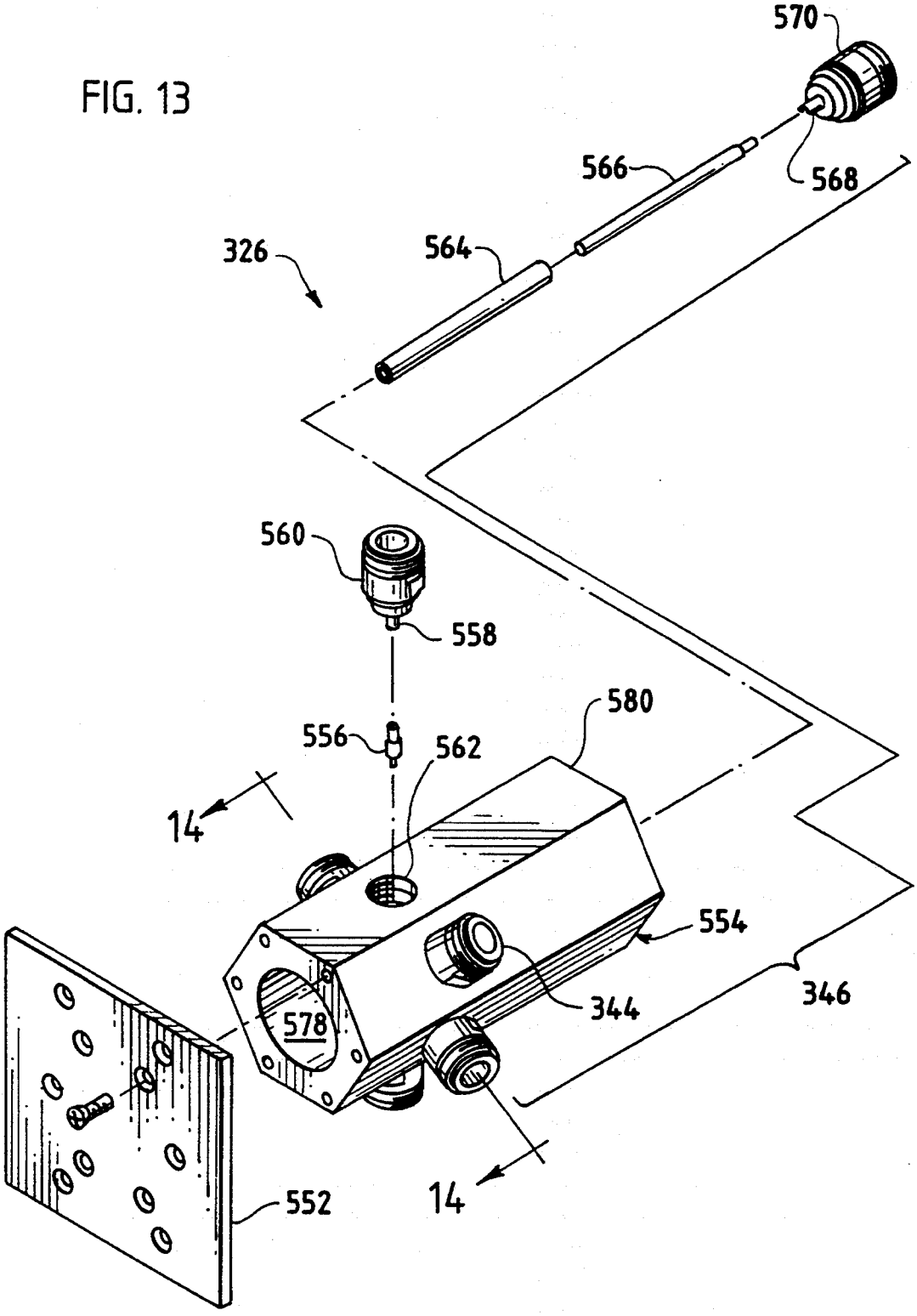
Figure 14A:
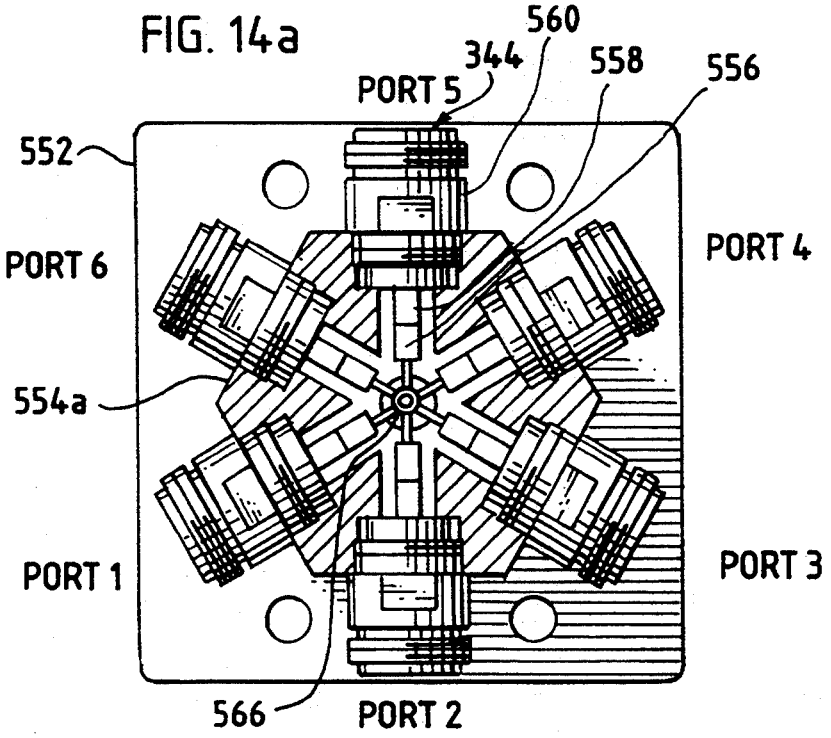
Figure 14B:
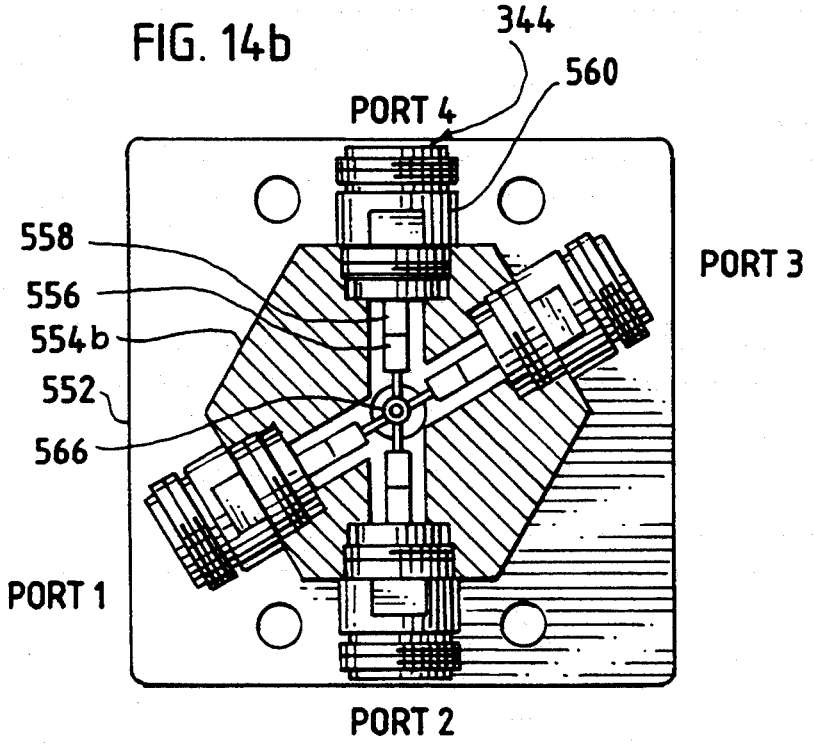
Figure 15:
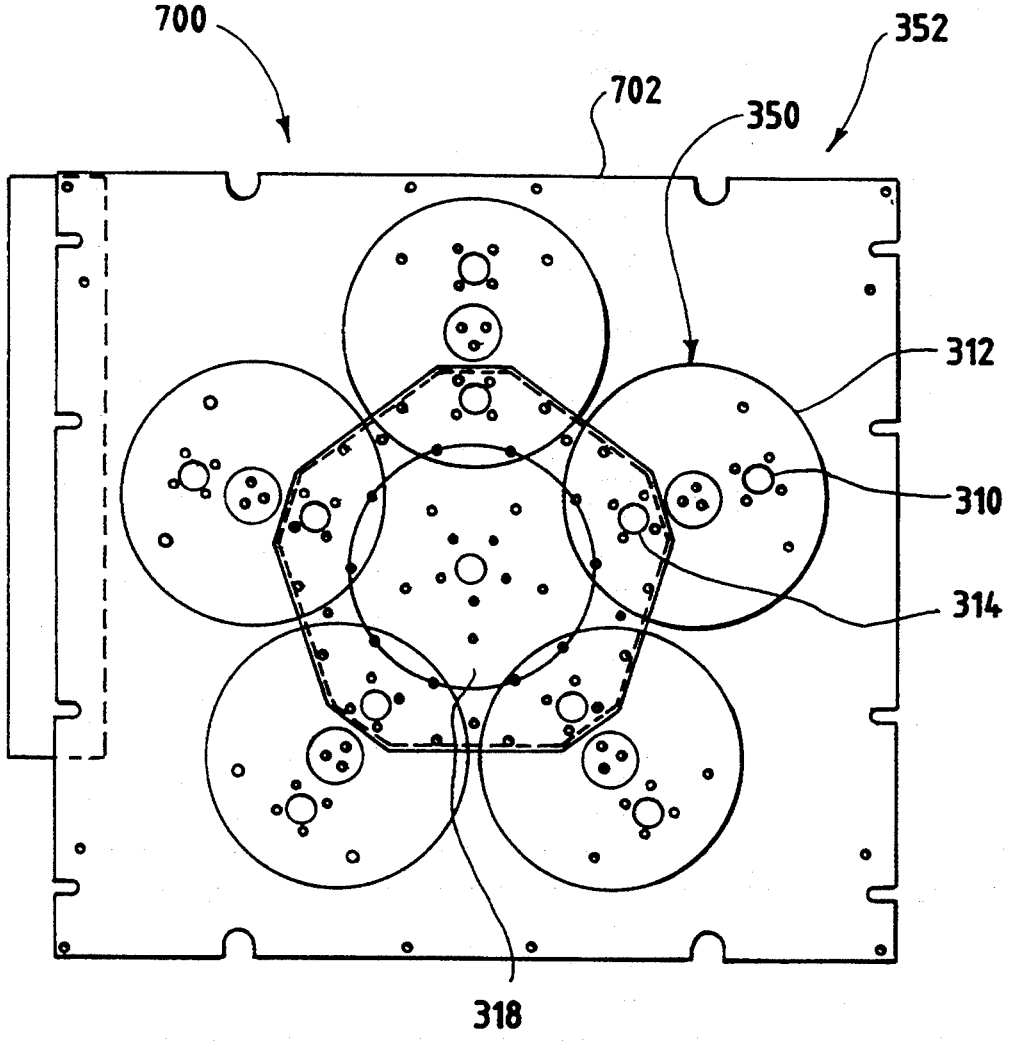
Figure 16:
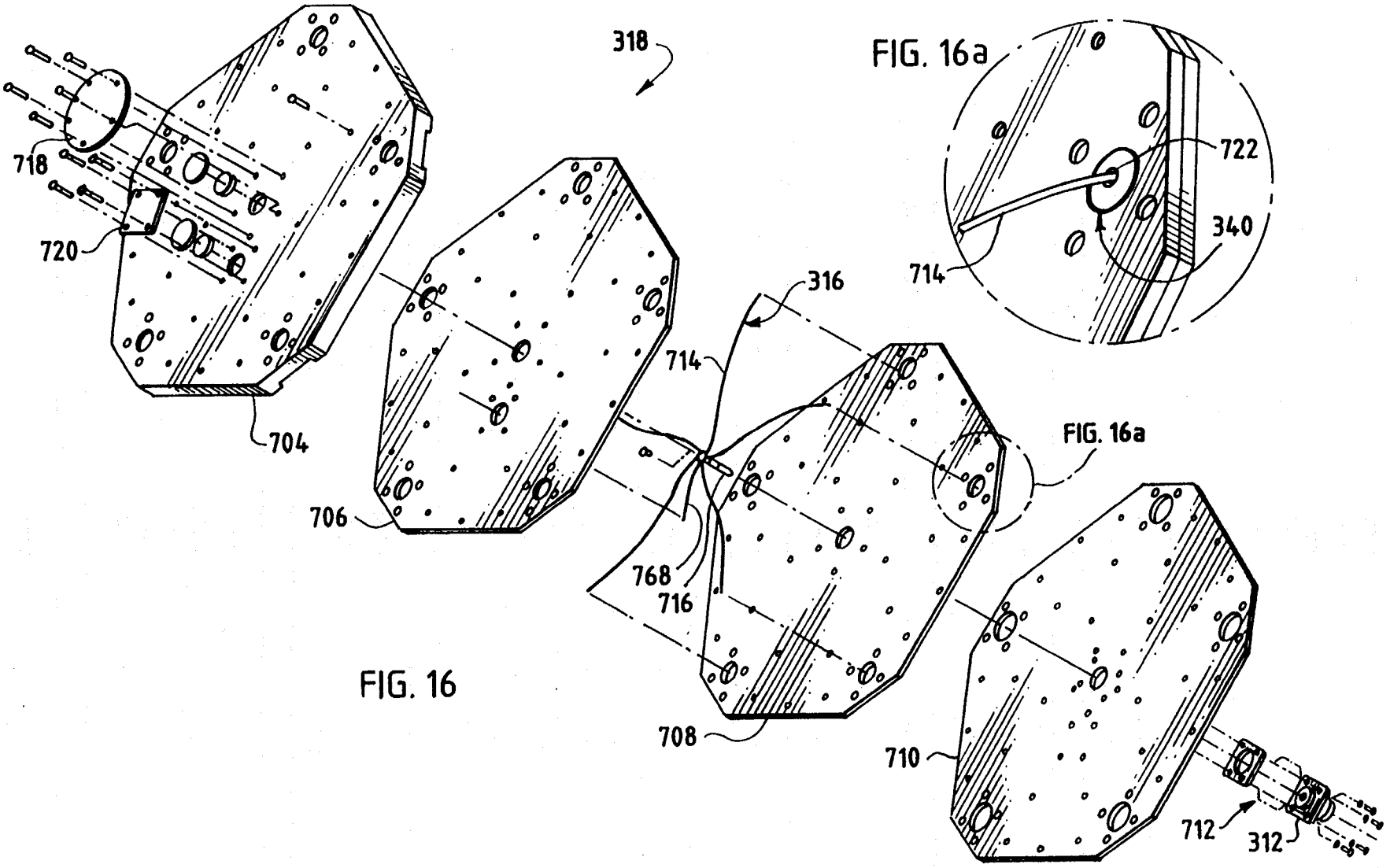
Figure 17:
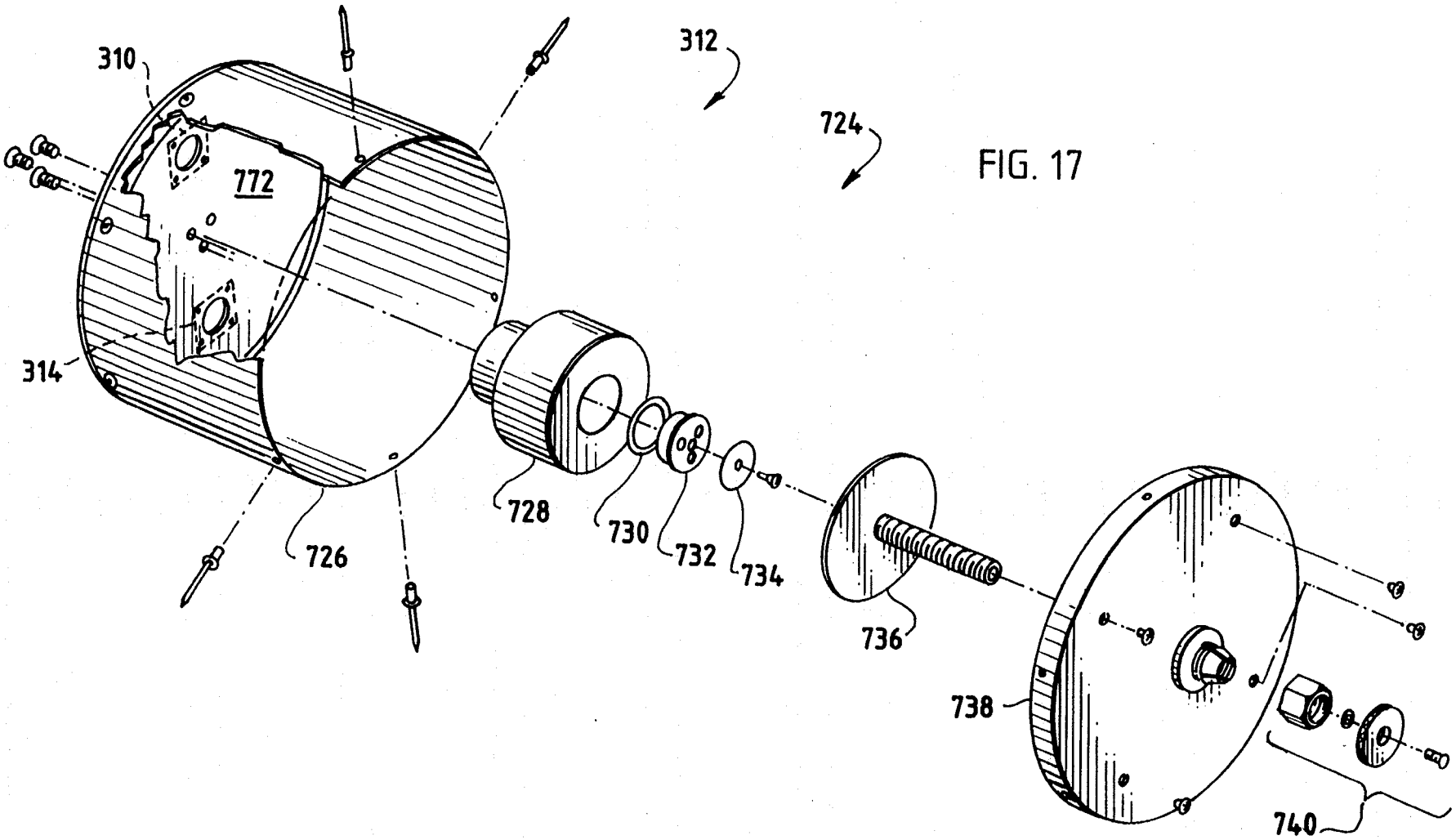
Figure 18:
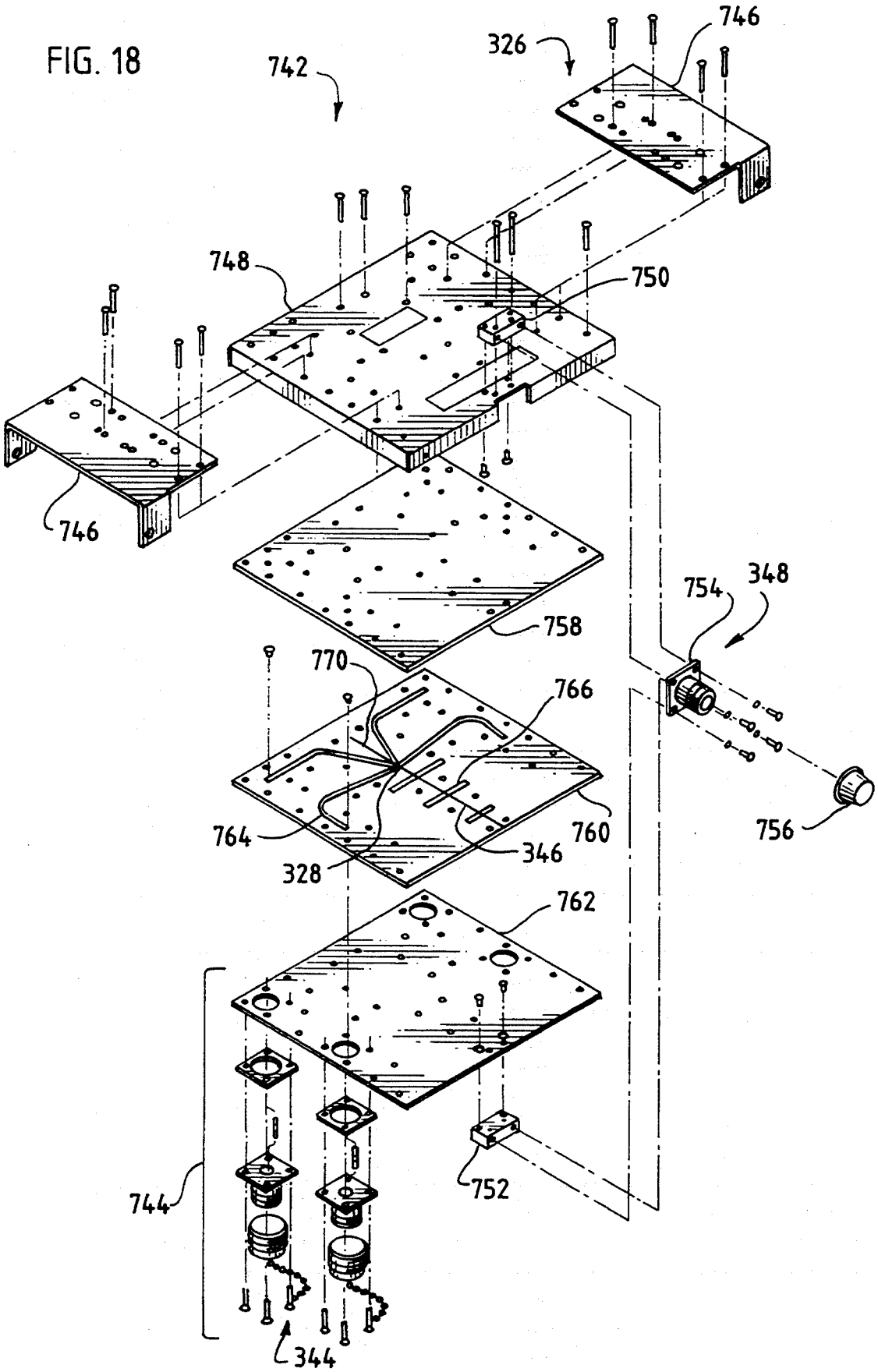

FIGS. *2a–2d* are "insertion loss" diagrams representing a first aspect of the electrical performance of a prior art combiner system of the type shown in FIG. 1, as determined by a computer simulation;

FIGS. *3a–3b* are "output return loss" diagrams representing a second aspect of the electrical performance of a prior art combiner system of the type shown in FIG. 1, as determined by a computer simulation;

FIG. 4 is a simplified block diagram of a combiner system 300 constructed according to the present invention;

FIGS. *5a–5d* are "insertion loss" diagrams representing a first aspect of the electrical performance of the inventive combiner system 300 FIG. 4, as determined by a computer simulation;

FIGS. *6a–6b* are "output loss" diagrams representing a second aspect of the electrical performance of the inventive combiner system 300 of FIG. 4, as determined by a computer simulation;

FIG. 7 is a Smith Chart representing the output match presented by a 20-channel combiner of conventional design having a single channel cavity, in which the resonant frequency of one cavity was swept across a range of operating frequencies at selected output impedances, as determined by a computer simulation;

FIG. 8 is a Smith Chart representing the final output match (i.e. the output match as seen by the antenna) presented by the combiner system 300 of the present invention across a range of operating frequencies, as determined by a computer simulation;

FIG. 9 is a front elevation view of a selected portion of a first embodiment 500 of the combiner system 300 of the present invention, showing: at least two groups of channels and at least one secondary junction, with additional similar groups of channels omitted for clarity;

FIG. 10 is a front perspective view, partially exploded, showing in greater detail one of the channel groups of the first embodiment 500 of the inventive combiner, bounded by the view lines 10—10 of FIG. 9;

FIG. 11 is an exploded front perspective view of a primary junction assembly for the channel group of FIG. 10;

FIG. 12 is an exploded front perspective view of a cavity used in the channel group of FIG. 10;

FIG. 13 is an exploded front perspective view of a showing in greater detail a secondary junction assembly of the first embodiment 500 of the inventive combiner, bounded by the view lines 13—13 of FIG. 9;

FIG. 14*a* is a rear cross-section view of the secondary junction assembly of FIG. 13, in a configuration for use with six channel groups, taken along the view lines 14—14 thereof;

FIG. 14*b* is a rear cross-section view of the secondary junction assembly of FIG. 13, in a configuration for use with four channel groups, taken along the view lines 14—14 thereof;

FIG. 15 is a front elevation view showing one of the channel groups of a second embodiment 700 of the inventive combiner;

FIG. 16 is an exploded front perspective view of a primary junction assembly for the channel group of FIG. 15;

FIG. 17 is an exploded front perspective view of a cavity used in the channel group of FIG. 15; and FIG. 18 is an exploded perspective view of a secondary junction assembly of the second embodiment 700 of the inventive combiner.

DETAILED DESCRIPTION OF THE PREFERRED EMBODIMENT

FIG. 4 is a simplified block diagram of a multichannel combiner system 300 constructed according to the present invention. The inventive combiner 300 shown herein is adapted for use with up to 20 transmitters, but preferred embodiments according to the invention are discussed herein which are adapted for use with up to 30 transmitters. One skilled in the art will appreciate how to modify the exemplary embodiments for use with more or fewer transmitters. Further, although the two alternative preferred embodiments of the inventive combiner disclosed in this application are implemented for use in the 800–1000 MHz frequency range, a skilled artisan will understand that the principles of the present invention can be advantageously applied in combiners designed for use at frequencies ranging from below 150 MHz to above 3000 MHz.

As best seen in FIG. 4, a combiner 300 constructed according to the present invention comprises a plurality of input ports 310 for receiving RF energy from respective transmitters 152 via suitable respective transmission lines 154. Each input port 310 is connected to a respective filter means 312*a*. Each filter means 312 is preferably a relatively narrow bandpass filter having its passband centered about the frequency on which the associated transmitter 152 operates. The filter means 312 may be implemented using any suitable bandpass filter technology, which may be selected depending on the operating frequency of the combiner and on other system performance and cost considerations. In preferred embodiments constructed according to the present invention and designed for operation in the 800–1000 MHz, the filters are preferably cavity resonators, and include a ceramic dielectric resonator element. Cavities of this type are known in the art.

The output signal from the transmitter is introduced into, and collected from, the filter means 312 using any means appropriate for the type of filter being used. For the cavity resonators described herein, wire loops 338, 342 are used, but other means, such as probes, could also be used. An adjustment means 336 is provided to control the resonant frequency of the filter means according to methods well known in the art. The signal from each transmitter 152 is provided at a respective output port 314 of the filter means 312.

The filters 312 function to preclude RF energy produced by one transmitter from being delivered to any other transmitter. The filter passband is selected to be wide enough to pass the transmitted signal, but narrow enough to reject the frequencies on which all other transmitters at the site operate. Thus, for each transmitter, the associated filter rejects substantially all of the RF energy which may be available from the other transmitters at the site. The minimum allowed frequency difference between adjacent channels for a combiner is a design parameter and is referred to as "channel separation." Preferred embodiments of the invention, which achieve acceptable performance with channel separation of 210 kHz and 600 kHz, are disclosed herein. However, the inventive combiner will also perform well in systems having: different frequency separation requirements.

Primary transmission lines 316 connect the output ports 314 of each filter to corresponding: input ports 340 of one of four primary junction or "star" assemblies 318. The primary transmission lines 316 may be any suitable transmission lines, such as coaxial cables or strip lines. Each primary junction assembly 318 has five input ports 340 which are connected in parallel to a single output port 322.

Secondary transmission lines 324 connect the output ports 322 of each primary junction assembly 318 to a secondary junction assembly 326. The secondary junction assembly 326 has four input ports 344*a, f, k,* and *p,* which are connected in parallel to a single junction point 328. A suitable impedance transformer means 346 is interposed between the junction point 328 and the secondary junction output port 348. The output port 348 of the secondary junction assembly 326 is connected to a transmission line 132 which is, in turn, connected to the antenna 134. Two cascaded "layers" of small junction assemblies 318 and 326 are provided instead of a single large 20-input junction assembly because it is difficult to construct large junction assemblies in which the transmission path between the input ports and the central junction has the desired transmission line characteristics.

As noted above, the filter means of prior art combiners are typically matched to an output impedance roughly approximating the impedance of the antenna system. Commercial antenna systems typically exhibit design impedances around 50 ohms, and conventional combiners have typically employed filter cavities matched to an output impedance in the range of 35 to 50 ohms.

In contrast to the prior art, the filters 312 of the present invention are preferably matched to an output impedance substantially lower than that of the antenna system. According to the present invention, the output impedance of the filters 312 is selected to substantially minimize the reactance contributions produced by the filters 312 over the operating range of the combiner. Preferably, the output impedance of the filters 312 is further selected such that the far-off-resonance reactance contributions from the cavities (and associated transmission lines), and the reactance contributions from resonant cavities (and associated transmission lines), are opposite in sign and roughly balanced in magnitude, and therefore tend to compensate or cancel each other out. Thus, in the inventive combiner, to the extent possible consistent with other system constraints, the cumulative far-off-resonance reactance contribution from the cavities (and lines) will be capacitive, when the reactance contribution from the resonant cavities (and lines) is inductive, and vice versa.

The value of the output impedance used for filters 312 is preferably selected by means of computer simulations which optimize total system performance and may depend on a large number of system parameters. However, it is believed that in many applications, suitable filter output impedances will be in the range of 10–18 ohms. As best seen in the Smith Chart 202 of FIG. 7, a combiner employing filters having output impedances around 20 ohms (curve 210) exhibits an output match with relatively small amounts of reactance over a substantial frequency range.

The impedance transformer means 346 is provided to match the relatively low output impedance of the filter means 312 to the design impedance of the antenna system. The impedance transformer 346 may be realized by any suitable means, such as a section of transmission line, lumped components, or distributed components. For example, in exemplary embodiments of the invention, the impedance transformer has been implemented as a quarter-wave transmission line section having an appropriate characteristic impedance selected by calculating the geometric mean of the output impedance of the filters and the design impedance of the antenna system, subject to later computer optimization. In one embodiment, a coaxial transmission line is used; in another, a strip line transmission line is used. Other types of transmission lines may also be suitable.

In connecting the output ports 314 of the filters 312 to the combiner's final output port 348, it is desirable to minimize reactance contributions which may be caused by the transmission lines 316 and 324 and the junction assemblies 318 and 326. Accordingly, the combiner 300 is constructed such that the effective electrical length of each transmission path from the output port 314 of a filter 312 to the final output port 348 closely approximates an integral multiple of one half wavelength at the center of the combiner's operating frequency range. A transmission line having an electrical length of exactly an integral multiple of one half wavelength is electrically "invisible" in that it contributes no reactance to the circuit.

Because it is difficult to exactly fabricate all of the transmission lines and associated components to the desired dimensions, adjustable reactance elements 320 or 330 may be provided at primary or secondary junctions 318, 326 respectively, or at other suitable locations. Each adjustable reactance element 320, 330 may be implemented as a shorted stub of adjustable length is connected in shunt to the center junction point of the primary or secondary junction assemblies. However, other adjustable reactance elements could also be used. Unlike the adjustable reactance elements 120, 130 of the conventional combiner 100 (see FIG. 1), elements 320, 330 are provided solely to accommodate manufacturing tolerances, and are intended for adjustment only once, by the manufacturer, and not for field adjustment at the installation site. Because the inventive combiner 300 provides excellent performance over a bandwidth of about 35 MHz, there is no need to provide user-adjustable means for optimizing performance in a small subset of the operating range. Accordingly, reactance elements 320, 330 are depicted within the boundaries of the junction assemblies 318, 326, respectively, to indicate that elements 320, 330 are not intended to be adjusted by the user.

Figure 6A:
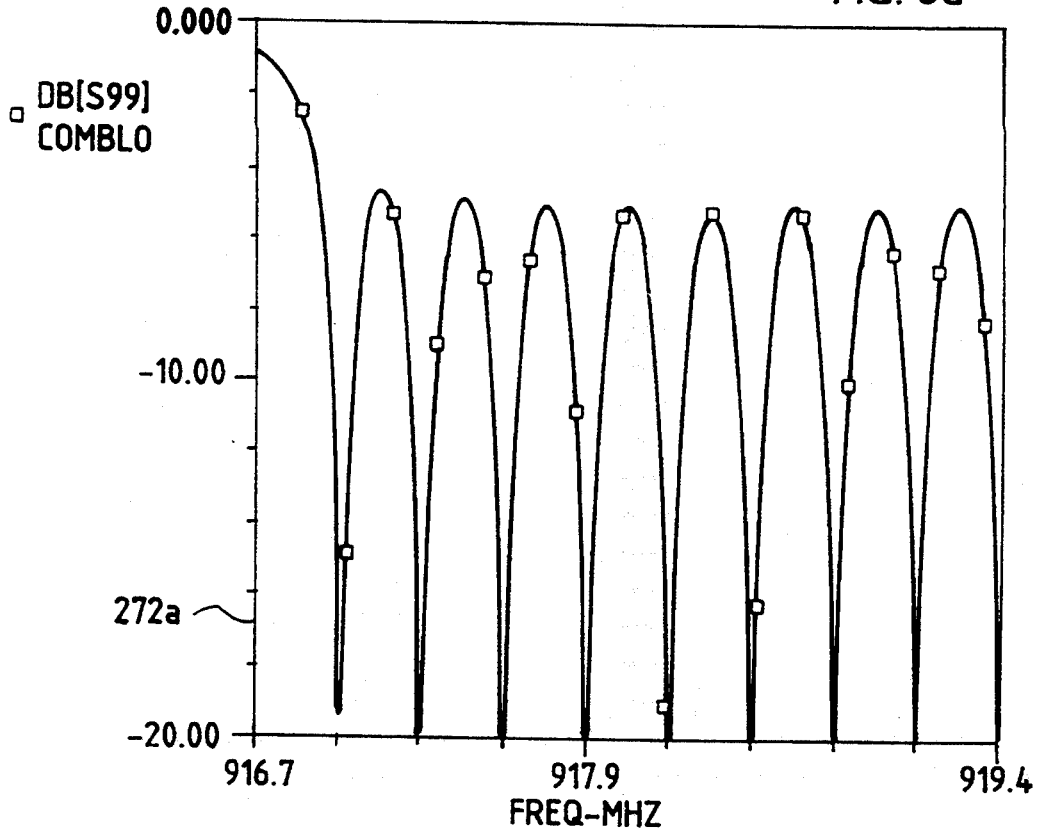
Figure 6B:
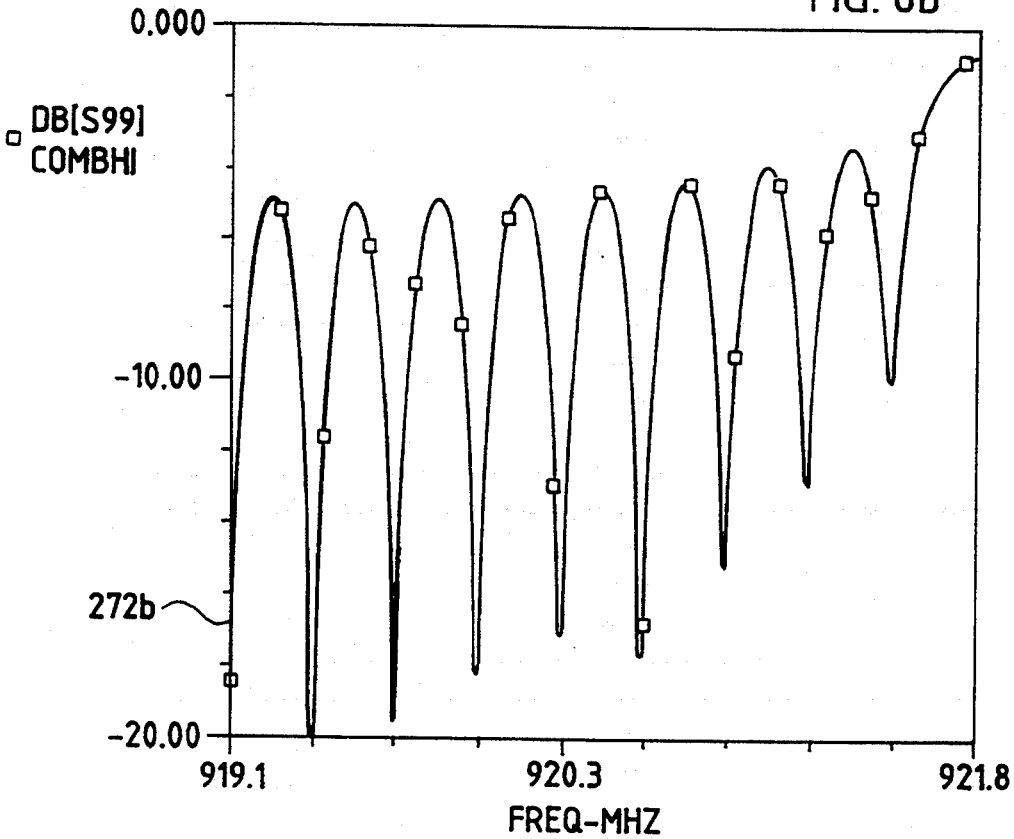

The computer-simulated performance of a 16-channel combiner constructed according to the present invention is summarized in FIGS. 5–6 and 8. Except for the differences in combiner design, the same parameters were used to simulate the performance of the inventive combiner as were used to simulate the performance of the conventional combiner. The combiner is designed to operate in a 33 MHz bandwidth around 933.5 MHz, with a channel separation of 300 kHz. In order to illustrate worst case performance, the lowest available 16 channels within the specified operating range were selected. This condition maximizes the reactances produced by the cavities and the transmission lines. FIGS. *5a–5d* present diagrams *270a–270d* representing the insertion loss of the inventive combiner in the frequency range of 916 to 922 MHz. FIGS. *6a–6b* present diagrams *272a–272d* representing the output return loss of the inventive combiner over that frequency range. FIG. 8 presents Smith Chart 232, in which curve 234 represents the output match of the inventive combiner, using a cavity having an output impedance of approximately 18 ohms, over the design frequency range.

As best seen in FIGS. *5a–5d*, the insertion loss of the inventive combiner suffers from substantially less variation over the design frequency range than that exhibited by the conventional combiner. At the highest selected frequency, the combiner has a worst-case insertion loss of about 2.7 dB (i.e. about 54 percent of the original signal is available at the output of the combiner). As best seen in FIGS. *6a–6b*, the output return loss is also comparatively uniform over the design frequency range. The worst case output return loss is no less than 10.0 dB (i.e. only about 10 percent of the power available at the output of the combiner is returned as reflected power). As best seen in FIG. 8, the combiner output impedance is approximately 50 ohms, with negligible reactance, over the entire frequency range. Other simulations show that practical embodiments of the inventive combiner provide good performance over a 35 MHz design bandwidth using both normal and narrow-band channel spacing parameters. Thus, a combiner constructed according to the present invention provides a significant improvement in performance over prior art combiners.

First and second alternative preferred embodiments 500 and 700 of a combiner constructed according to the present invention are shown in FIGS. 9–14 and FIGS. 15–18 respectively. The combiners 500 and 700 generally conform to the combiner block diagram 300 of FIG. 4; where possible, the reference numbers of FIG. 4 are used to denote equivalent parts in embodiments 500 and 700.

Embodiment 500 (FIGS. 9–14) is a transmitter combiner designed to accommodate 1–30 channels in a frequency range of 869–894 MHz. The minimum channel separation of this combiner is 210 kHz. FIG. 9 is a front elevation view of a portion of the combiner 500 showing the rack-mounted mechanical construction of two groups 352 of five channels, along with the secondary junction assembly 326. FIG. 10 is a partially exploded front perspective view showing a single group 352 of five channels.

In this embodiment, the filters (resonators) 312, 350 for each set 352 of five channels are grouped in a predefined mechanical arrangement with an associated primary junction assembly. The filters 312 and the primary junction assembly 318 are preferably mounted on a mounting plate 510 so they may be, installed and removed as a unit. The output port 314 of each filter 312 is connected to an input port 340 of the primary junction assembly 318 using suitable transmission lines, such as coaxial transmission lines 324. The output port 322 of each primary junction assembly 318 is connected to an input port 344 of a secondary junction assembly 326 using suitable transmission lines (not shown).

Secondary junction assemblies 554*a* and 554*b* are shown for connection respectively to six or four primary junction assemblies 318. If a six-to-one secondary junction assembly 554*a* is used, the capacity of the combiner 500 is 30 channels. If a four-to-one secondary junction assembly 554*b* is used, the capacity of the combiner 30 is 20 channels.

FIG. 11 shows the internal construction details of a primary junction housing 572 for housing primary junction assembly 318. The housing 572 has a body 512, which is preferably formed as a rectangular box-like structure using any suitable construction materials, such as extruded aluminum. The housing preferably has a rear cover panel 514 and a front cover panel 516. The front cover panel 516 preferably has a plurality of apertures for mounting the electrical connectors for the input and output ports 340, 322 of the primary junction assembly 318. Suitable transmission lines 574, which may be coaxial cables, are provided to couple the connectors to the assembly 318. The primary junction assembly is preferably mounted to the front cover panel 516 using appropriate fasteners. A signaling channel junction assembly 518 may also be disposed in the in the housing 572.

FIG. 12 shows an exploded view of a suitable filter 312 for use in the combiner 500. The filter 312 is preferably implemented as a cavity resonator having a ceramic-dielectric resonator element 540, although other suitable filter means could also be used. The filter 312 preferably has a cavity housing comprising a body portion 520, a bottom plate 528, and a top cover assembly 522.

The ceramic resonator element 540 is suspended between the bottom plate 528 and the front cover assembly 522 by suitable mounting parts. A ring shaped locator groove 530 is provided in the bottom plate 528 to retain the resonator mounting hardware in a preferred position within the cavity. The resonator element 540 is suspended between top and bottom tubular quartz spacers 544 and 534 which locate the resonator element in a preferred vertical position. Items 532, 536, 542, and 546 are silicon gaskets. Spiral shim 548 and Smalley-wave spring 550 apply a controlled compressive force to secure the resonator element and its mounting parts in position.

Tuning shaft assembly 524 is used to adjust the resonant frequency of the filter 312 by varying the position of a ceramic plug 526 with respect to the resonator element 540. The plug 526 is attached to a threaded rod so that the frequency may be adjusted by turning an adjustment knob 336. Locking knob 531 may be used to prevent inadvertent movement of adjustment knob 336. A pair of extrusion tubes 576 are provided in the body portion 520 for receiving appropriate fasteners for securing the cavity 312, 350 to the mounting plate 510.

The resonator element 540 of the filter of FIG. 12 is a donut-shaped ceramic (dielectric) resonator. The natural resonant frequency of the resonator itself is determined by its dimensions, inner and outer diameter, and height. A larger resonator will have a lower frequency.

A conductive object such as metal in close proximity to a ceramic resonator will change its resonant frequency in the positive direction. The larger the object and the closer it is, the higher the resulting frequency. When the ceramic resonator is mounted in the cavity 520, the inside walls of the cavity are close enough to affect the frequency of the resonator.

The tuning element 526 is made from the same type of ceramic as the resonator. When inserted into the center hole in the resonator, it adds to the dimensions of the resonator, bringing the resonant frequency down. The size and travel of the tuning element is chosen so that the resonator is tunable across the full frequency range 869 to 894 MHz. When fully withdrawn, the tuning element has a small residual effect on the resonant frequency.

The natural frequency of the resonator is adjusted so that the assembled cavity operates in the desired frequency range.

The resonator must be supported by a structure meeting several requirements: It must be non-conductive, so as not to severely affect the frequency and loss of the resonator; it must have low RF loss properties, so as not to dissipate large amounts of RF energy; it must be mechanically rigid and strong, to hold the resonator firmly fixed in its location relative to the cavity and tuning element and to resist damage from shock and vibration; it must also possess the desired thermal expansion characteristics to meet design requirements. A cylindrical tube of quartz glass meets the above requirements and has a thermal coefficient of expansion, to which is less than 1 ppm/degree C.

The resonator is held in place by two quartz tubes 534, and 544, inserted into counterbores in the resonator and bottom and top end covers 528 and 522. Thin silicone rubber washers 532, 536, 542, and 546 are added for shock absorption. When the filter is assembled at room temperature, the wave spring 550 is compressed half way, so that it is free to expand and contract and exert axial pressure on the assembly throughout its operating temperature range.

When the temperature of the filter is raised, the cavity 520, which is made of aluminum with a tc of 19 ppm/degree C., will expand. Its radial expansion moves its inner walls away from the resonator, thereby lowering the resonant frequency. Its axial expansion displaces the bottom and top end caps from each other. The location of the wave spring and the near-zero expansion of the quartz tubes ensure that the resonator stays fixed relative to the bottom end cap while the tuning element follows the top end cap. Thus, the tuning element is withdrawn from the resonator by a small amount, thereby counteracting the effect of the cavity walls. By proper design of the comprised elements, the filter has been made temperature stable for practical applications. Some temperature effect is contributed by the resonator and tuning element and by the tuning shaft, but these are comparatively small.

The tuning element 526 is attached to a threaded metal shaft 527. The shaft constitutes a conductor, which is grounded to the top end cap 512 and open ended where the tuning plug attaches. This enables the shaft to support a TEM-mode resonance, which may be at a frequency that interferes with the operation of the filter. If the ceramic plug 526 were bonded directly to the shaft, in this application there would be an interfering resonance on the shaft. The interference is eliminated by interposing a ceramic insulator 529 between the shaft and tuning plug. The insulator is made from alumina, which has the desired electrical and mechanical properties. It effectively detunes the shaft resonance without affecting the performance of the filter.

FIGS. 13, 14*a*, and 14*b* show the construction of a secondary junction assembly 326, 554 for use with combiner 500. FIG. 13 is an exploded front perspective view of the assembly. FIG. 14*a* is a rear cross-section view showing a junction configuration 554*a* adapted for connection to six primary junction assemblies. FIG. 14*b* is a rear cross-section view showing a junction configuration 554*b* adapted for connection to four primary junction assemblies. The impedance transformer means 346 is preferably formed as an integral part of the secondary junction assembly.

The secondary junction assembly 554 comprises a tubular body portion 580 which is preferably constructed of metal or another suitable conductive material, and a bottom cover plate 552. The body portion 580 preferably has a longitudinally extending: central aperture 578 of a circular cross section. Several radial apertures 562 are provided in the body 580 extending: from the outer surface thereof to the central aperture 578 in order to receive connectors 560 forming the input ports 344 of the assembly 554. For the six-input configuration 554*a*, six apertures and associated connectors are provided. For the four-input configuration 554*b*, four apertures and associated connectors are provided. An output connector 570 forming the output port 348 of the secondary junction 326 (and the combiner itself) is mounted in the bottom end of the central aperture.

The impedance transformer means 346 is formed as a quarter-wavelength section of coaxial transmission line. The transmission line is cooperatively formed by the central aperture 578, a center conductor element 566 extending longitudinally therein, and, a Teflon dielectric 564 disposed concentrically about the center conductor element 566. The dimensions of the transmission line elements are preferably selected to provide an electrical length of one-quarter wavelength at the center of the combiner's design frequency range, and to provide the desired characteristic impedance. The desired characteristic impedance is typically selected by calculating the geometric mean between the output impedance of the filter means 312 and the design impedance of the antenna system, subject to later computer optimization. The center conductor element 566 is electrically connected the solder cup 568 forming the center conductor of the output connector 570 and extends to the region of the input connectors 560. A pin 556 is provided for each input connector 560 to join its center conductor 558 to the center conductor element 566.

Embodiment 700 (FIGS. 15–18) is a combiner designed to accommodate 5–20 channels in a frequency range of 925–950 MHz. The minimum channel separation of this combiner is 600 kHz. FIG. 15 is a front elevation view of a portion of the combiner 700 showing the rack-mounted mechanical construction of a single group 352 of five channels, including a primary junction assembly 318.

In embodiment 700, the filters (resonators) 312, 350 for each set 352 of five channels is grouped in a predefined mechanical arrangement (or "module") with an associated primary junction assembly 318. The filters 312 and the primary junction assembly 318 are preferably mounted on a mounting plate 702 so they may be installed and removed as a unit. The filters 312 are preferably implemented as cylindrical cavities having a ceramic resonator element (see FIG. 17). The filters 312 are preferably arranged in a radial pattern such that their output ports 314 are aligned with the input ports of the primary junction assembly 318 ("star assembly"), so that the primary junction assembly 318 may be mounted directly atop the filter enclosures. The filter input ports 310 are also visible.

FIG. 16 is an exploded view showing the construction of a primary junction assembly 318 ("star assembly") for use with embodiment 700. The primary junction assembly is constructed as a strip line comprising a conductive top cover 704, a top dielectric sheet 706, a "center conductor" 714, a bottom dielectric sheet 708, and a conductive bottom cover 710. The dielectric sheets 706, 708 are preferably a formed from a suitable insulating material, such as Teflon.

The center conductor 714 has five radially-extending conductor arms for contacting the input ports 340, 722 of the primary junction assembly. The five conductor arms are joined at a center conductor pin 716 which is connected to the center conductor of a connector 712 forming the output port 312 of the primary junction assembly. Thus, the center conductor forms a set of transmission lines for providing a connection between the input ports 340 and the output port of the primary junction assembly. The center conductor 712 is preferably formed from copper strip or sheet material. The resulting characteristic impedance of the transmission lines formed by the arms of the center conductor is 95 ohms.

A small tuning stub 768 preferably extends from the center conductor pin 716. The tuning stub 768 is used to fine tune the impedance match provided by the combiner. Tuning is performed only once, during manufacturing, to compensate for production tolerances. The tuning stub is not intended for field adjustment. Caps 720 and 718 are provided to cover access apertures for the center conductor and the tuning stub.

FIG. 17 shows an exploded view of a suitable filter 312, 724 for use in the combiner 700. The filter 724 is preferably implemented as a cylindrical cavity resonator having a ceramic-dielectric resonator element 728, although other suitable filter means, such as coaxial or waveguide resonators, could also be used. The filter 724 preferably has a cylindrical cavity housing comprising a body portion 726, a bottom cap 772, and a top cap 738. The cavity housing is preferably constructed of copper-plated Invar, but other sturdy conductive materials could also be used. The ceramic resonator element 728 is preferably secured to the bottom cap 772 of the housing using mounting plug 732, silicone rubber washer 730, and compensating disk 734.

A tuning disk 736 is provided to adjust the resonant frequency of the cavity. The tuning disk 736 comprises a metal disk attached to a small length of threaded rod, which is used to mount the disk to the top cap 738. The resonant frequency of the cavity is adjusted by rotating the rod, thereby adjusting the position of the disk with respect to the ceramic resonator element 728. Mounting and locking hardware 740 is provided to fix the position of the tuning disk 736 to prevent inadvertent changes to the resonant frequency of the cavity.

FIG. 18 is an exploded view showing the construction of a secondary junction assembly 326, 742 ("star junction"), for use with embodiment 700. The output port 322 of each primary junction assembly 318 is connected to one of the input ports 344 of the secondary junction assembly 742 via a suitable transmission line, such as a coaxial cable. The secondary junction assembly 742 is preferably constructed in strip line technology. The strip line comprises a conductive top layer 748, an upper dielectric layer 758, a center conductor 764, a lower dielectric layer 760, and a conductive bottom layer 762. The dielectric layers 758, 760 are preferably a formed from a suitable insulating material, such as Teflon. The secondary junction assembly is mechanically secured to mounting brackets 746.

The center conductor 764 has four radially-extending "input arms" for connection with the input ports 344 of the secondary junction assembly. The four input arms are joined at a central junction point 328. A suitable RF connector 744 is provided for each input port 344. A pin is provided to connect each input arm of the center conductor 764 to the center conductor of the associated input port connector. The input arms are designed so that when assembled, the total length of each arm and input connector is one half wavelength. If the secondary junction is used with fewer than four 5-channel modules, unused inputs may be left open, because the half-wave section transforms this open circuit into another open circuit at the junction point. Thus, the unused input is electrically "invisible" at the center frequency.

A small tuning stub 770 preferably extends from the junction point 328. The tuning stub 770 is used to fine tune the impedance match provided by the combiner. Tuning is performed only once, during manufacturing, to compensate for production tolerances. The tuning stub is not intended for field adjustment.

The impedance transformer means 346 is formed as a quarter-wavelength section of strip line extending from the central junction 328 to a connector 754 at output port 348. Small conductor arms 766 extending transversely from the impedance transformer means 346 form a low pass filter. The impedance transformer 346 is coupled to the output connector 754 by suitable end launcher blocks 750, 752.

The above-described embodiments of the invention are merely examples of ways in which the invention may be carried out. Other ways may also be possible, and are within the scope of the following claims defining the invention.

I claim:

1. A combiner having a lower operating frequency limit and an upper operating frequency limit, said upper and lower limits defining a combiner operating range of frequencies, the combiner constructed and arranged to couple a plurality of transmitters, each operating at a different but closely adjacent frequency, to a single antenna, the combiner comprising:

a plurality of filter means, each having an input port for receiving radio frequency energy from one of a plurality of transmitters, and a resonant frequency corresponding to frequency of operation of one of said plurality of transmitters;

each of said filter means having an output port;

each of said filter means constructed and adjusted to have an output impedance such that:

at an operating frequency corresponding to either the lower operating frequency limit or the upper operating frequency limit:

(i) the output admittance of said filter means when tuned to resonate at the operating frequency has a first real part and a first imaginary part;

(ii) the output admittance of said filter means when resonating at the operating frequency is transformed through transmission lines, that are not an integral multiple of one-half wavelength at resonance, to have a second real part and a second imaginary part;

(iii) the combined output admittances, at the operating frequency, of the remainder of said filter means have a third real part and a third imaginary part; and (iv) the second imaginary part is equal to the third imaginary part, but is opposite in sign;

impedance transformer means electrically connected to the output ports of each of said filter means, and said impedance transformer means having a single output port;

a radio-frequency energy output means for providing said energy to a single antenna; and said output port of said impedance transformer means being electrically coupled to said radio frequency energy output means.

2. The combiner of claim 1, wherein the filter means comprise narrow bandpass filters.

3. The combiner of claim 1, wherein the input impedance of the antenna is 50 ohms.

4. The combiner of claim 1, wherein the output impedance of the filter means is in the range from 10 ohms to 20 ohms.

5. The combiner of claim 1, wherein the impedance transformer means comprises a quarter-wavelength section of coaxial transmission line.

* * * * *